US006382753B1

(12) United States Patent
Teramae et al.

(10) Patent No.: US 6,382,753 B1
(45) Date of Patent: May 7, 2002

(54) INK-JET RECORDING HEAD DRIVING METHOD AND INK-JET RECORDING APPARATUS

(75) Inventors: Hirofumi Teramae; Satoru Hosono, both of Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/580,556

(22) Filed: May 30, 2000

(30) Foreign Application Priority Data

May 28, 1999 (JP) ..... 11-149091
Oct. 28, 1999 (JP) ..... 11-307486
May 19, 2000 (JP) ..... 2000-148162

(51) Int. Cl.[7] ..... B41J 29/38
(52) U.S. Cl. ..... 347/10; 347/9; 347/11
(58) Field of Search ..... 347/9, 10, 11

(56) References Cited

U.S. PATENT DOCUMENTS 5,521,619 A * 5/1996 Suzuki et al. ..... 347/10
6,151,050 A * 11/2000 Hosono et al. ..... 347/70

FOREIGN PATENT DOCUMENTS

EP 0 827 838 A * 11/1998 ..... B41J/2/21
JP 11-058719 A * 3/1999 ..... B41J/2/01

* cited by examiner

*Primary Examiner*—John Barlow
*Assistant Examiner*—Alfred E. Dudding
(74) *Attorney, Agent, or Firm*—Sughrue Mion, PLLC

(57) ABSTRACT

An ink-jet recording head driving method of driving an ink-jet recording head having a pressure generating device corresponding to a pressure generating chamber communicating with a jetting hole includes a driving pulse generating step of generating a driving pulse by taking out part of a driving signal having a time length corresponding to one printing cycle and including a plurality of driving pulse waves, and an ink jetting step of jetting an ink particle through the jetting hole by applying the driving pulse to the pressure generating device to drive the pressure generating device for a predetermined operation. When the driving pulse generating step and the ink jetting step are repeated a plurality of times in one printing cycle to jet a plurality of ink particles, the succeeding ink jetting step is stated a predetermined time interval T after a point when the preceding ink jetting step is ended. The predetermined time interval T is equal to or longer than one period $T_H$ of the Helmholtz vibration of the pressure generating chamber.

14 Claims, 18 Drawing Sheets

| GRADATION | FIRST WAVEFORM | SECOND WAVEFORM | THIRD WAVEFORM | FOURTH WAVEFORM | DECODED VALUE |
|---|---|---|---|---|---|
| 1 (00) | × | × | × | × | (0000) |
| 2 (01) | × | ○ | × | ○ | (0100) OR (0001) |
| 3 (10) | ○ | × | ○ | × | (1000) OR (0010) |
| 4 (11) | | × | | × | (1010) |

INK-JET RECORDING HEAD DRIVING METHOD AND INK-JET RECORDING APPARATUS

BACKGROUND OF THE INVENTION

1. Field of the Invention

The present invention relates to an ink-jet recording head driving method, an ink-jet recording apparatus provided with an ink-jet recording head to be driven by the ink-jet recording head driving method, and a computer readable medium having data stored thereon for controlling the ink-jet recording apparatus by a computer.

2. Description of the Related Art

Generally, an ink-jet recording apparatus includes a recording head having a nozzle plate provided with a plurality of jetting holes arranged in a row, a carriage mechanism for moving the recording head in a main scanning direction, i.e., a direction along the width of a recording sheet, and a sheet feed mechanism for feeding a recording sheet in a sub-scanning direction, i.e., a sheet feed direction.

The recording head has pressure generating chambers respectively communicating with the jetting holes, and pressure generating devices for varying the pressure in the pressure generating chambers. Ink pressure in the pressure generating chamber is changed by applying a driving pulse to the pressure generating device to jet an ink particle through the jetting hole.

The carriage mechanism moves the recording head along the main scanning direction. While the recording head is being moved by the carriage mechanism, the recording head jets ink particles at times specified by dot pattern data. Upon the arrival of the recording head at a terminal end of its scanning stroke, the sheet feed mechanism feeds a recording sheet in the feed direction and the carriage mechanism returns the recording head to a starting end of its stroke. After the recording sheet has been fed, the carriage mechanism moves the recording head again in the scanning direction. The recording head jets ink particles while the same is thus being moved.

The foregoing operations are repeated to record an image represented by the dot pattern data on the recording sheet.

FIG. 19A shows the waveform of a driving pulse to be applied to the pressure generating device of the recording head and FIG. 19B shows the variation of the shape of an ink surface (meniscus) in the jetting hole varying according to the driving pulse, in which time is measured on the horizontal axis and displacement is measured on the vertical axis.

As shown in FIG. 19A, the driving pulse has a filling waveform section between points P50 and P51 for expanding the pressure generating chamber to fill the pressure generating chamber with the ink, holding waveform section between points P51 and P52 for keeping the pressure generating chamber in an expanded state, and an ink jetting waveform section between points P52 and P53 for jetting the ink through the jetting hole by contracting the pressure generating chamber.

As shown in FIG. 19B, the ink in the jetting hole is drawn inward and the surface of the ink in the jetting hole becomes concave in a period corresponding to the filling waveform section between the points P50 and 51 of the driving pulse. The changing direction of the shape of the surface of the ink in the jetting hole changes from the drawing direction to the jetting direction in a period corresponding to the holding waveform section between the points P51 and P52 of the driving pulse. The ink is jetted in an ink particle in a period corresponding to the ink jetting waveform section between the points P52 and P53 of the driving pulse. This ink jetting phenomenon is ended at a point P53' slightly after time corresponding to the end point P53 of the ink jetting waveform section of the driving pulse. As indicated by imaginary lines (chain lines) in FIG. 19A, driving pulses are applied successively to the pressure generating device to jet ink particles successively.

However, time intervals between the successive driving pulses which are applied to the pressure generating device should be shortened in order to achieve a recording under higher speed than that of usual. When a plurality of gradation value data are used within one printing cycle in order to record an image, the second driving pulse should be applied to the pressure generating device before the meniscus becomes fully steady after the jetting caused by the first driving pulse. As a result, the ink particle which is jetted by the second driving pulse loses its shape and is scattered.

As shown in FIG. 19B, the surface of the ink in the jetting hole vibrates at the Helmholtz vibration period $T_H$ of the pressure generating chamber when an ink particle is jetted through the jetting hole. If the starting point P54 of the succeeding driving pulse coincides with a bottom of the Helmholtz vibration, i.e., a point when the surface of the ink in the jetting hole is fully drawn inward, the ink particle is unable to hold its shape and the ink is scattered.

SUMMARY OF THE INVENTION

The present invention has been made in view of the foregoing problems and it is therefore an object of the present invention to provide an ink-jet recording head driving method capable of providing a plurality of driving pulses at optimum time intervals and of preventing the scatter of ink particles.

Another object of the present invention is to provide an ink-jet recording apparatus provided with an ink-jet recording head that is driven by the above-mentioned ink-jet recording head driving method.

Another object of the present invention is to provide a computer readable medium having a data stored thereon for controlling the above-mentioned ink-jet recording apparatus by a computer.

According to a first aspect of the present invention, an ink-jet recording head driving method of driving an ink-jet recording head having a pressure generating device corresponding to a pressure generating chamber communicating with a jetting hole and having a specific period ($T_H$) of Helmholtz vibration, said ink-jet recording head driving method comprises: a driving pulse generating step of generating a driving pulse by taking out part of a driving signal having a time length corresponding to one printing cycle and including a plurality of driving pulse waves; and an ink jetting step of jetting an ink particle through the jetting hole by applying the driving pulse to the pressure generating device to drive the pressure generating device for a predetermined operation; wherein the driving signal has a waveform that makes a time interval between a point when a preceding ink jetting step is ended and a point when a succeeding ink jetting step is started is equal to or longer than one period ($T_H$) of the Helmholtz vibration of a meniscus when the driving pulse generating step and the ink jetting step are repeated a plurality of times in one printing cycle to jet a plurality of the ink particles.

Preferably, the time interval is a natural multiple of the period ($T_H$) of the Helmholtz vibration of the meniscus.

According to a second aspect of the present invention, an ink-jet recording head driving method of driving an ink-jet recording head having a pressure generating device corresponding to a pressure generating chamber communicating with a jetting hole and having a specific period ($T_H$) of Helmholtz vibration, said ink-jet recording head driving method comprises: a driving pulse generating step of generating a driving pulse by taking out part of a driving signal having a time length corresponding to one printing cycle and including a plurality of driving pulse waves; and an ink jetting step of jetting an ink particle through the jetting hole by applying the driving pulse to the pressure generating device to drive the pressure generating device for a predetermined operation; wherein the driving signal has a waveform that makes a succeeding ink jetting step start after a point of time when a meniscus of ink in the jetting hole is drawn toward the pressure generating chamber to the utmost by the preceding ink jetting step when the driving pulse generating step and the ink jetting step are repeated a plurality of times in one printing cycle to jet a plurality of the ink particles.

According to a third aspect of the present invention, an ink-jet recording head driving method of driving an ink-jet recording head having a pressure generating device corresponding to a pressure generating chamber communicating with a jetting hole and having a specific period ($T_H$) of Helmholtz vibration, said ink-jet recording head driving method comprises: a driving pulse generating step of generating a driving pulse by taking out part of a driving signal having a time length corresponding to one printing cycle and including a plurality of driving pulse waves; and an ink jetting step of jetting an ink particle through the jetting hole by applying the driving pulse to the pressure generating device to drive the pressure generating device for a predetermined operation; wherein the driving signal has a waveform that makes a succeeding ink jetting step start after a time point when a vibration of a meniscus of the ink in the jetting hole caused by a preceding ink jetting step is substantially stabilized when the driving pulse generating step and the ink jetting step are repeated a plurality of times in one printing cycle to jet a plurality of the ink particles.

Preferably, the point of time when the vibration of the meniscus of the ink in the jetting hole is substantially stabilized is a point of time when an amplitude of the vibration of the meniscus is decreased to about 30% of a maximum amplitude or below.

Preferably, the point of time when the vibration of the meniscus of the ink in the jetting hole is substantially stabilized is a point of time when the amplitude of the meniscus is decreased to about 15% of the maximum amplitude or below.

Preferably, the driving pulse has a filling waveform section for expanding the pressure generating chamber to fill the pressure generating chamber with the ink and an ink jetting waveform section for jetting the ink through the jetting hole by contracting the pressure generating chamber.

Preferably, the driving pulse further comprises a holding waveform section for keeping the pressure generating chamber in an expanded state caused by the filling waveform section.

Preferably, the filling waveform section is a waveform section which increases a voltage at a fixed slope so as to make the pressure generating chamber expand, and the ink jetting waveform section is a waveform section which decreases a voltage at a fixed slope so as to make the pressure generating chamber contract.

Preferably, the driving pulse has an ink jetting waveform section that makes the pressure generating chamber held in an expanded state contract to jet an ink particle through the jetting hole.

According to a fourth aspect of the present invention, an ink-jet recording apparatus comprises: an ink-jet recording head provided with a pressure generating chamber communicating with a jetting hole through which an ink particle is jetted and having a specific period ($T_H$) of Helmholtz vibration, and a pressure generating device corresponding to the pressure generating chamber; and a head driving unit that generates a driving pulse by tanking out part of a driving signal having a time length corresponding to one printing cycle and including a plurality of driving pulse waves and applies the driving pulse to the pressure generating device to drive the pressure generating device for a predetermined operation to jet an ink particle through the jetting hole; wherein the driving signal has a waveform that makes a time interval between a point when a preceding ink jetting step is ended and a point when a succeeding ink jetting step is started is equal to or longer than one period ($T_H$) of the Helmholtz vibration of a meniscus when the head driving unit repeats the ink jetting step a plurality of times in one printing cycle to jet a plurality of the ink particles.

Preferably, the time interval is a natural multiple of the period ($T_H$) of the Helmholtz vibration of the meniscus.

According to a fifth aspect of the present invention, an ink-jet recording apparatus comprises: an ink-jet recording head provided with a pressure generating chamber communicating with a jetting hole through which an ink particle is jetted and having a specific period ($T_H$) of Helmholtz vibration, and a pressure generating device corresponding to the pressure generating chamber; and a head driving unit that generates a driving pulse by tanking out part of a driving signal having a time length corresponding to one printing cycle and including a plurality of driving pulse waves and applies the driving pulse to the pressure generating device to drive the pressure generating device for a predetermined operation to jet the ink particle through the jetting hole; wherein the driving signal has a waveform that makes a succeeding ink jetting step start after a point of time when a meniscus of the ink in the jetting hole is drawn toward the pressure generating chamber to the utmost by a preceding ink jetting step when the head driving unit repeats the ink jetting step a plurality of times in one printing cycle to jet a plurality of the ink particles.

According to a sixth aspect of the present invention, an ink-jet recording apparatus comprises: an ink-jet recording head provided with a pressure generating chamber communicating with a jetting hole through which an ink particle is jetted and having a specific period ($T_H$) of Helmholtz vibration, and a pressure generating device corresponding to the pressure generating chamber; and a head driving unit that generates a driving pulse by tanking out part of a driving signal having a time length corresponding to one printing cycle and including a plurality of driving pulse waves and applies the driving pulse to the pressure generating device to drive the pressure generating device for a predetermined operation to jet the ink particle through the jetting hole; wherein the driving signal has a waveform that makes a succeeding ink jetting step start after a time point when a vibration of a meniscus of the ink in the jetting hole caused by a preceding ink jetting step is substantially stabilized when the ink jetting step performed by the head driving unit is repeated a plurality of times in one printing cycle to jet a plurality of the ink particles.

Preferably, the point of time when the vibration of the meniscus of the ink in the jetting hole is substantially stabilized is a point of time when an amplitude of the vibration of the meniscus is decreased to about 30% of a maximum amplitude or below.

Preferably, the point of time when the vibration of the meniscus of the ink in the jetting hole is substantially stabilized is a point of time when the amplitude of the meniscus is decreased to about 15% of the maximum amplitude or below.

Preferably, the driving pulse has a filling waveform section for expanding the pressure generating chamber to fill the pressure generating chamber with the ink and an ink jetting waveform section for jetting the ink through the jetting hole by contracting the pressure generating chamber.

Preferably, the driving pulse further comprises a holding waveform section for keeping the pressure generating chamber in an expanded state caused by the filling waveform section.

Preferably, the filling waveform section is a waveform section which increases a voltage at a fixed slope so as to make the pressure generating chamber expand, and the ink jetting waveform section is a waveform section which decreases a voltage at a fixed slope so as to make the pressure generating chamber contract.

Preferably, the driving pulse has an ink jetting waveform section that makes the pressure generating chamber held in an expanded state contract to jet the ink particle through the jetting hole.

According to a seventh aspect of the present invention, a computer readable medium has a data on a driving signal waveform stored thereon which is read by a computer to control a jetting of an ink particle by an ink-jet recording apparatus, the ink-jet recording apparatus comprising an ink-jet recording head provided with a pressure generating chamber communicating with a jetting hole through which an ink particle is jetted and having a specific period ($T_H$) of Helmholtz vibration, and a pressure generating device corresponding to the pressure generating chamber; and a head driving unit that generates a driving pulse by tanking out part of a driving signal having a time length corresponding to one printing cycle and including a plurality of driving pulse waves and applies the driving pulse to the pressure generating device to drive the pressure generating device for a predetermined operation to jet the ink particle through the jetting hole; wherein the driving signal which is produced using the data has a waveform that makes a time interval between a point when a preceding ink jetting step is ended and a point when a succeeding ink jetting step is started is equal to or longer than one period ($T_H$) of the Helmholtz vibration of a meniscus when the head driving unit repeats the ink jetting step a plurality of times in one printing cycle to jet a plurality of the ink particles.

Preferably, the time interval is a natural multiple of the period ($T_H$) of the Helmholtz vibration of the meniscus.

According to an eighth aspect of the present invention, a computer readable medium has a data on a driving signal waveform stored thereon which is read by a computer to control a jetting of an ink particle by an ink-jet recording apparatus, the ink-jet recording apparatus comprising an ink-jet recording head provided with a pressure generating chamber communicating with a jetting hole through which an ink particle is jetted and having a specific period ($T_H$) of Helmholtz vibration, and a pressure generating device corresponding to the pressure generating chamber; and a head driving unit that generates a driving pulse by tanking out part of a driving signal having a time length corresponding to one printing cycle and including a plurality of driving pulse waves and applies the driving pulse to the pressure generating device to drive the pressure generating device for a predetermined operation to jet the ink particle through the jetting hole; wherein the driving signal which is produced using the data has a waveform that makes a succeeding ink jetting step start after a point of time when a meniscus of the ink in the jetting hole is drawn toward the pressure generating chamber to the utmost by a preceding ink jetting step when the head driving unit repeats the ink jetting step a plurality of times in one printing cycle to jet a plurality of the ink particles.

According to a ninth aspect of the present invention, a computer readable medium has a data on a driving signal waveform stored thereon which is read by a computer to control a jetting of an ink particle by an ink-jet recording apparatus, the ink-jet recording apparatus comprising an ink-jet recording head provided with a pressure generating chamber communicating with a jetting hole through which an ink particle is jetted and having a specific period ($T_H$) of Helmholtz vibration, and a pressure generating device corresponding to the pressure generating chamber; and a head driving unit that generates a driving pulse by tanking out part of a driving signal having a time length corresponding to one printing cycle and including a plurality of driving pulse waves and applies the driving pulse to the pressure generating device to drive the pressure generating device for a predetermined operation to jet the ink particle through the jetting hole; wherein the driving signal which is produced using the data has a waveform that makes a succeeding ink jetting step start after a time point when a vibration of a meniscus of the ink in the jetting hole caused by a preceding ink jetting step is substantially stabilized when the ink jetting step performed by the head driving unit is repeated a plurality of times in one printing cycle to jet a plurality of the ink particles.

Preferably, the point of time when the vibration of the meniscus of the ink in the jetting hole is substantially stabilized is a point of time when an amplitude of the vibration of the meniscus is decreased to about 30% of a maximum amplitude or below.

Preferably, the point of time when the vibration of the meniscus of the ink in the jetting hole is substantially stabilized is a point of time when the amplitude of the vibration of the meniscus is decreased to about 15% of the maximum amplitude or below.

Preferably, the driving pulse has a filling waveform section for expanding the pressure generating chamber to fill the pressure generating chamber with the ink and an ink jetting waveform section for jetting the ink through the jetting hole by contracting the pressure generating chamber.

Preferably, the driving pulse further comprises a holding waveform section for keeping the pressure generating chamber in an expanded state caused by the filling waveform section.

Preferably, the filling waveform section is a waveform section which increases a voltage at a fixed slope so as to make the pressure generating chamber expand, and the ink jetting waveform section is a waveform section which decreases a voltage at a fixed slope so as to make the pressure generating chamber contract.

Preferably, the driving pulse has an ink jetting waveform section that makes the pressure generating chamber held in an expanded state contract to jet the ink particle through the jetting hole.

BRIEF DESCRIPTION OF THE DRAWINGS

The above and other objects, features and advantages of the present invention will become apparent from the following description taken in connection with the accompanying drawings, in which.

DESCRIPTION OF THE PREFERRED EMBODIMENTS

An ink-jet recording apparatus in a first embodiment according to the present invention and an ink-jet recording head driving method of driving an ink-jet recording head included in the ink-jet recording apparatus in the first embodiment will be described hereinafter.

Figure 1:
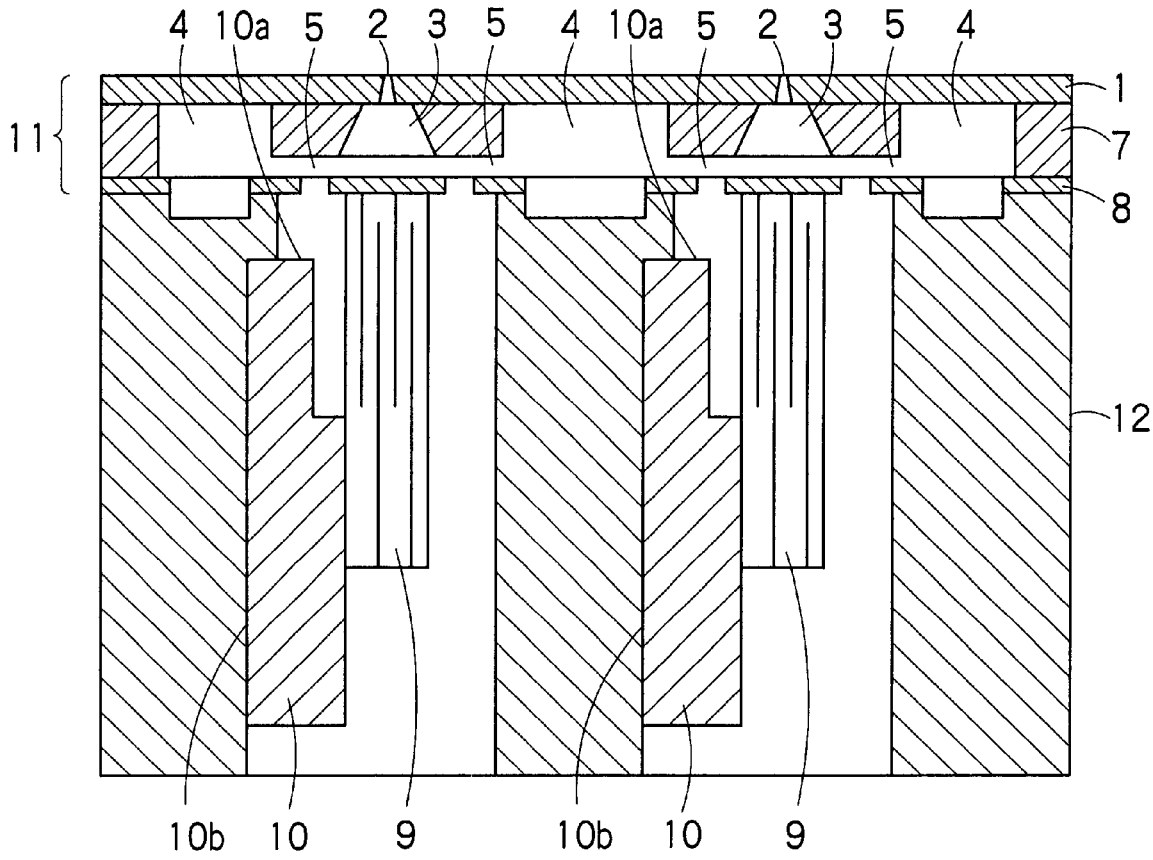
FIG. 1 is a sectional view of an ink-jet recording head employed in ink-jet recording apparatuses in first to third embodiments according to the present invention.

Referring to FIG. 1 showing an ink-jet recording head employed in the ink-jet recording apparatus in the first embodiment, there are shown a nozzle plate 1 provided with jetting holes 2, a passage plate 7 defining ink passages, and an elastic plate 8. The nozzle plate 1 and the elastic plate 8 are attached closely to the opposite surfaces of the passage plate 7, respectively, to form an ink passage unit 11.

The ink passage unit 11 is provided with pressure generating chambers 3, a common ink chamber 4 and ink inlets 5 connecting the pressure generating chambers 3 to the common ink chamber 4. Piezoelectric vibrators (pressure generating devices) 9 are connected to the elastic plate 8. When a driving signal is given to the piezoelectric vibrator 9 to contract the piezoelectric vibrator 9, ink is sucked from the common ink chamber 4 through the ink inlet 5 into the corresponding pressure generating chamber 3. An ink particle is jetted through the jetting hole 2 by extending the piezoelectric vibrator 9 to compress the pressure generating chamber 3.

Each piezoelectric vibrator 9 is formed by alternately superposing piezoelectric elements parallel to an extending direction and conductive elements parallel to the extending direction. The piezoelectric vibrator 9 is a vibrator of a longitudinal vibration mode that contracts in a direction perpendicular to the conductive elements when charged, and extends in a direction perpendicular to the conductive layers in a transient state where the piezoelectric vibrator is discharged. The piezoelectric vibrators 9 are arranged at predetermined pitches and back end parts of the piezoelectric vibrators 9 are attached to a rigid base plate 10 to form a vibrator unit. The forward end surface 10*a* and a side surface 10*b* of the base plate 10 are attached to a frame 12 with the forward ends of the piezoelectric vibrators 9 set to the elastic plate 8. Since the two surfaces 10*a* and 10*b* of the base plate 10 are attached to the frame 12, the interaction of the piezoelectric vibrators 9 can be prevented by limiting the propagation of the vibration of the piezoelectric vibrator 9 driven by a driving signal through the base plate 10 to the other piezoelectric vibrators 9 to the least possible extent.

In this ink-jet recording head, the Helmholtz frequency $F_H$ of the pressure generating chambers 3 is expressed by:

$$F_H = \frac{1}{2\pi}\sqrt{\frac{M_n + M_s}{(C_i + C_v)M_n \cdot M_s}} \quad (1)$$

where $C_i$ is fluid compliance representing the compressibility of the ink in the pressure generating chamber 3, $C_v$ is the rigidity compliance of the members, such as the elastic plate 8 and the nozzle plate 1, forming the pressure generating chamber 3, $M_n$ is the inertance of the jetting hole 2, $M_n$ is the inertance of the ink inlet 5.

In Expression (1), the fluid compliance $C_i$ is expressed by:

$$C_i = \frac{V}{\rho c^2} \quad (2)$$

where V is the volume of the pressure generating chamber 3, ρ is the density of the ink and c is sound velocity.

The rigidity compliance $C_v$ of the pressure generating chamber 3 coincide with the static deformation ratio of the pressure generating chamber 3 when a pressure is applied to the pressure generating chamber 3.

The Helmholtz frequency will be more concretely described. Supposing that the pressure generating chamber 3 has a length in the range of 0.5 to 2 mm, a width in the range of 0.1 to 0.2 and a depth in the range of 0.05 to 0.5 mm. Then, the Helmholtz frequency $F_H$ of the pressure generating chamber 3 is in the range of about 70 to about 200 kHz.

Driving methods of driving the ink-jet recording head shown in FIG. 1 are classified roughly into two groups; a group of push-jet driving methods and a group of pull-jet driving methods.

Figure 2:
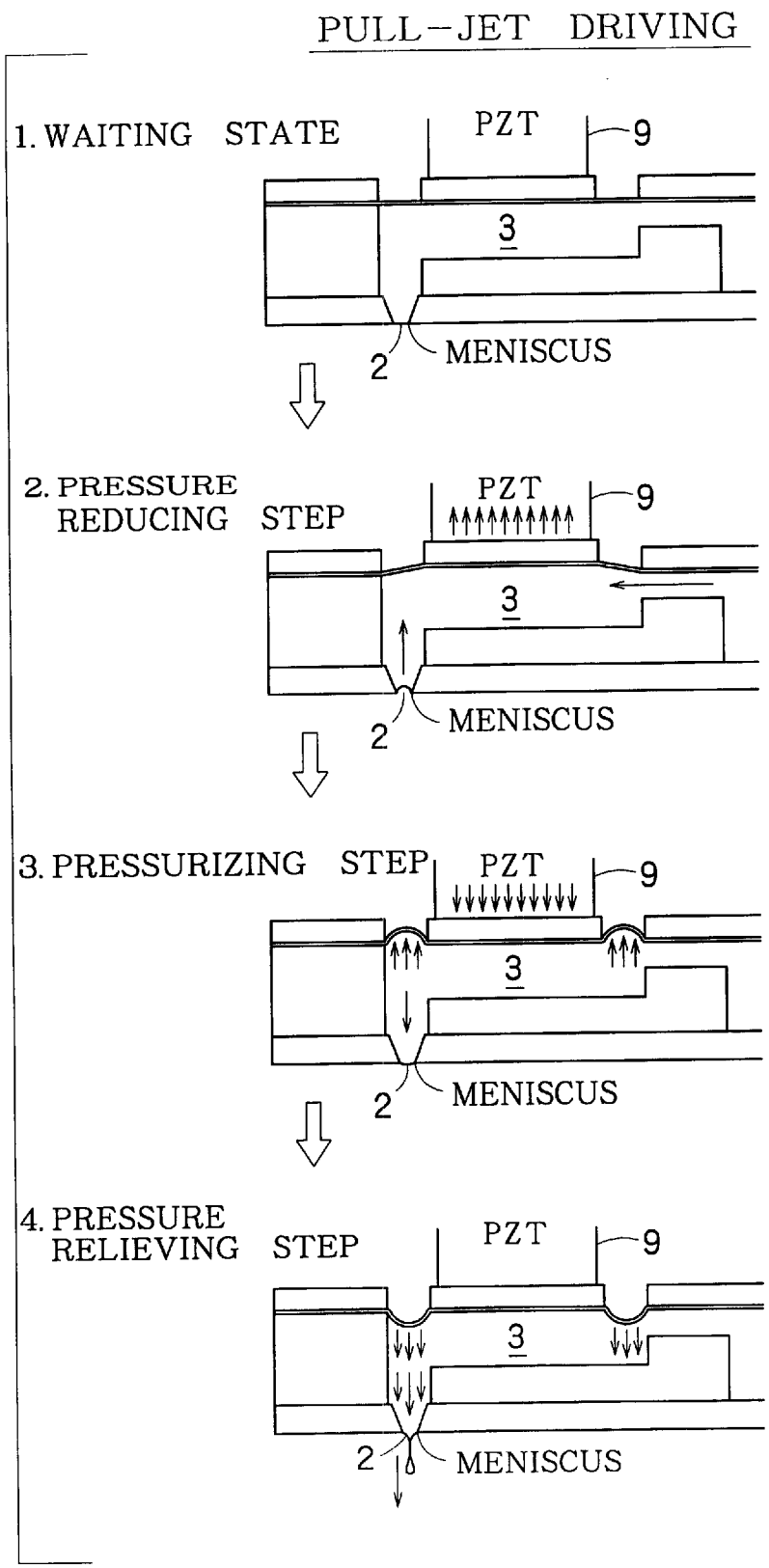
FIG. 2 is a schematic sectional view of assistance in explaining a pull-jet driving method, which is one of ink-jet recording head driving methods.

FIG. 2 is a view of assistance in explaining a pull-jet driving method. When the pull-jet driving method is used for driving the pressure generating chamber 3, the pressure generating chamber 3 is kept in neither an expanded state nor a contracted state in a waiting state. In this state, the pressure generating chamber 3 is kept in a reference state where the pressure generating chamber 3 has a reference volume. The pull-jet driving method includes a pressure reducing step, a pressurizing step and a pressure relieving step. The pressure reducing step contracts the piezoelectric vibrator 9 to fill the pressure generating chamber 3 with the ink by expanding the pressure generating chamber 3. Subsequently, the pressurizing step extends the piezoelectric vibrator 9 to apply pressure to the pressure generating chamber 3, and the pressure relieving step subsequent to the pressurizing step jets an ink particle through the jetting hole 2.

Figure 3:
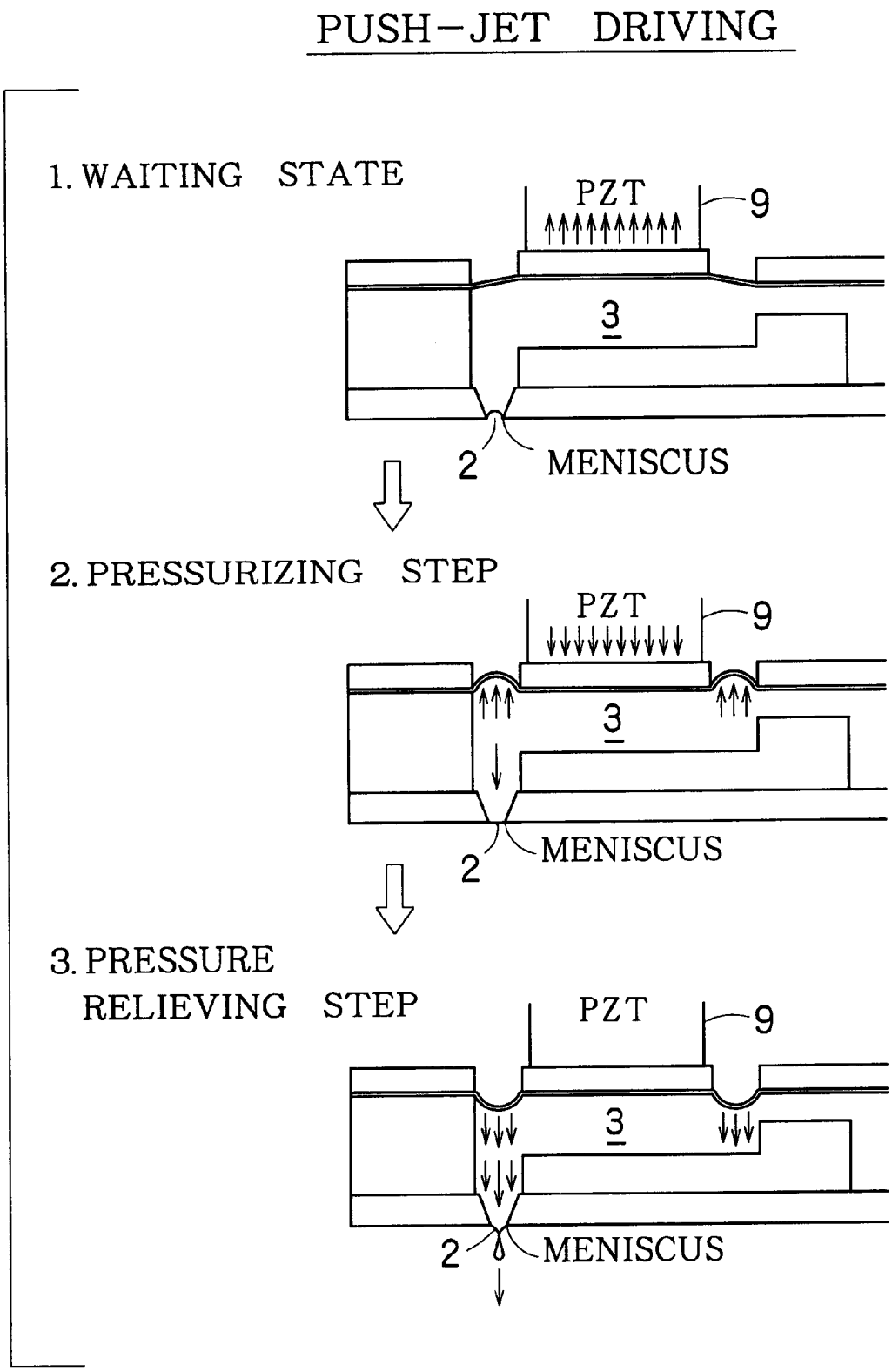
FIG. 3 is a schematic sectional view of assistance in explaining a push-jet driving method, which is one of ink-jet recording head driving methods.

FIG. 3 is a schematic sectional view of assistance in explaining a push-jet driving method. The push-jet driving method keeps the pressure generating chamber 3 in an expanded state in a waiting state. The push-jet driving method includes a pressurizing step and a pressure relieving step. The pressurizing step extends the piezoelectric vibrator 9 to apply pressure to the pressure generating chamber 3, and the pressure relieving step subsequent to the pressurizing step jets an ink particle through the jetting hole 2.

Figure 4:
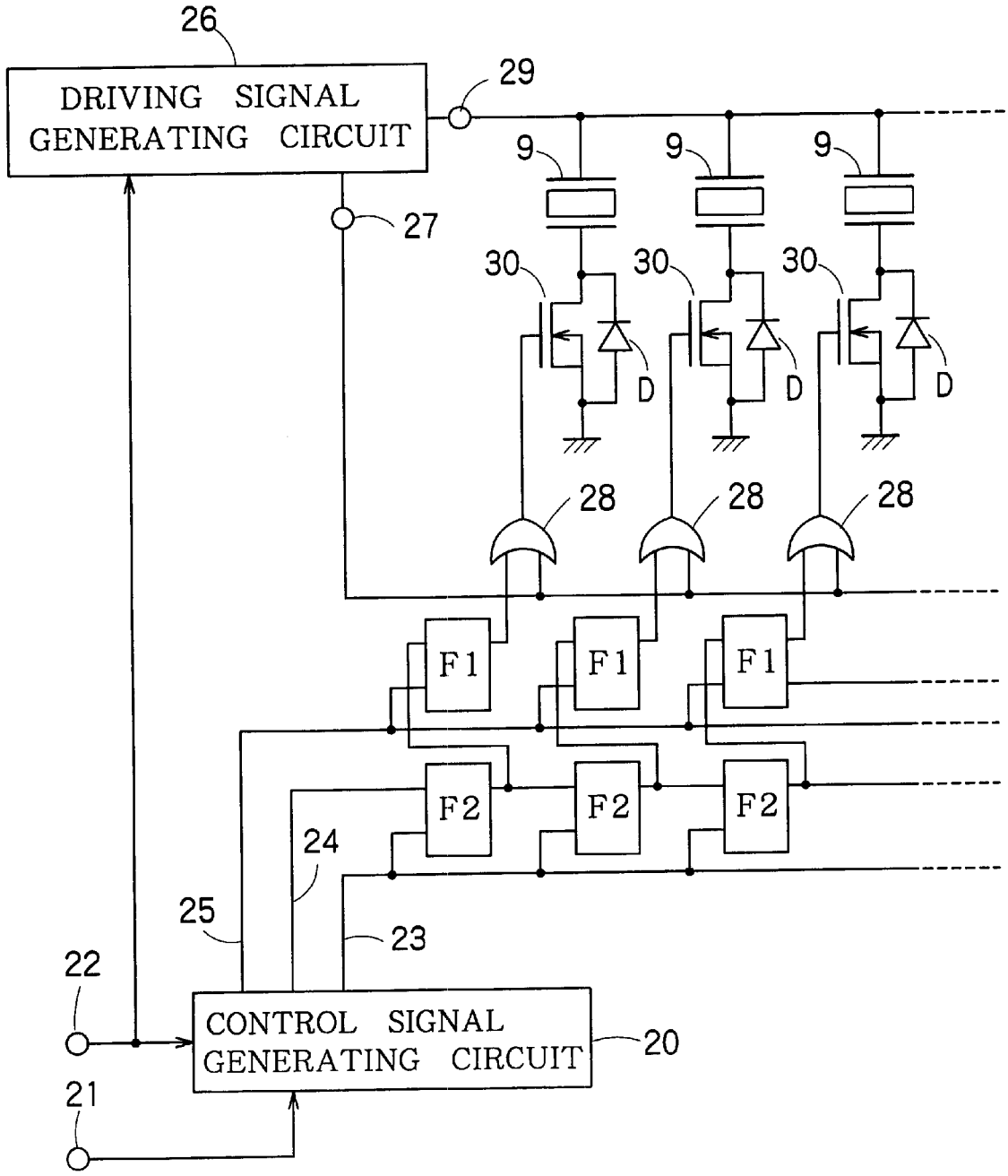
FIG. 4 is a block diagram of a driving circuit included in an ink-jet recording head driving unit included in the ink-jet recording apparatuses in the first to the third embodiments.

FIG. 4 shows a driving circuit included in an ink-jet recording head driving unit for driving the foregoing ink-jet recording head. As shown in FIG. 4, a control signal generating circuit 20 has input terminals 21 and 22 and output terminals 23, 24 and 25. A printing signal and a timing signal is applied to the input terminals 21 and 22 by an external printing data producing device, and a shift clock signal, a printing signal and a latch signal are provided on the output terminals 23, 24 and 25. A driving signal generating circuit 26 receives a timing signal applied to the input terminal 22 by the external printing data producing device, and provides driving signals for driving the piezoelectric vibrators 9 in synchronism with the timing signal. Flip-flops F1 form a latch circuit and flip-flops F2 form a shift register. Printing signals provided by the flip-flops F2 for the piezoelectric vibrators 9 are latched by the flip-flops F1. Selection signals, i.e., output signals of OR gates 28, are given to switching transistors 30.

Figure 5:
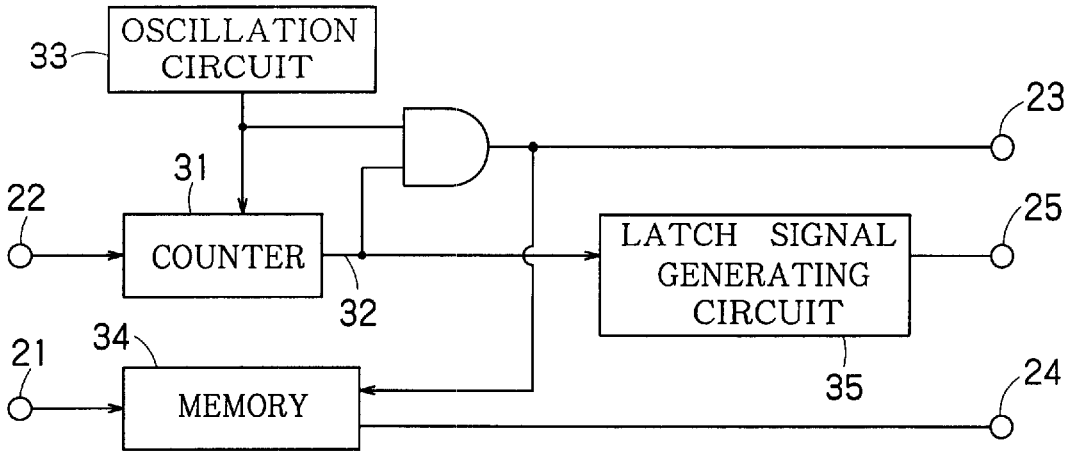
FIG. 5 is a block diagram of a control signal generating circuit included in the ink-jet recording apparatuses in the first to the third embodiments.

FIG. 5 shows the control signal generating circuit 20. The control signal generating circuit 20 has a counter 31 that is initialized by the leading edge of the timing signal (FIG. 7(I)) applied to the input terminal 22, and provides a carry signal 32 of LOW and stops counting operation when the number of counted clock pulses of a clock signal provided by an vibration circuit 33 coincides with the number of the piezoelectric vibrators 9 connected to the output terminal 29 of the driving signal generating circuit 26. The carry signal provided by the counter 31 is applied to an AND gate. The AND gate carries out logical AND between the carry signal provided by the counter 31 and the clock signal produced by the vibration circuit 33 and applies a shift clock signal to the output terminal 23. A memory 34 stores printing data applied to the input terminal 21 and having a number of bits coinciding with the number of the piezoelectric vibrators 9. The memory 34 provides the bits of the printing data stored therein one by one in a serial mode on the output terminal 24 in synchronism with the output signal of the AND gate.

Figure 7:
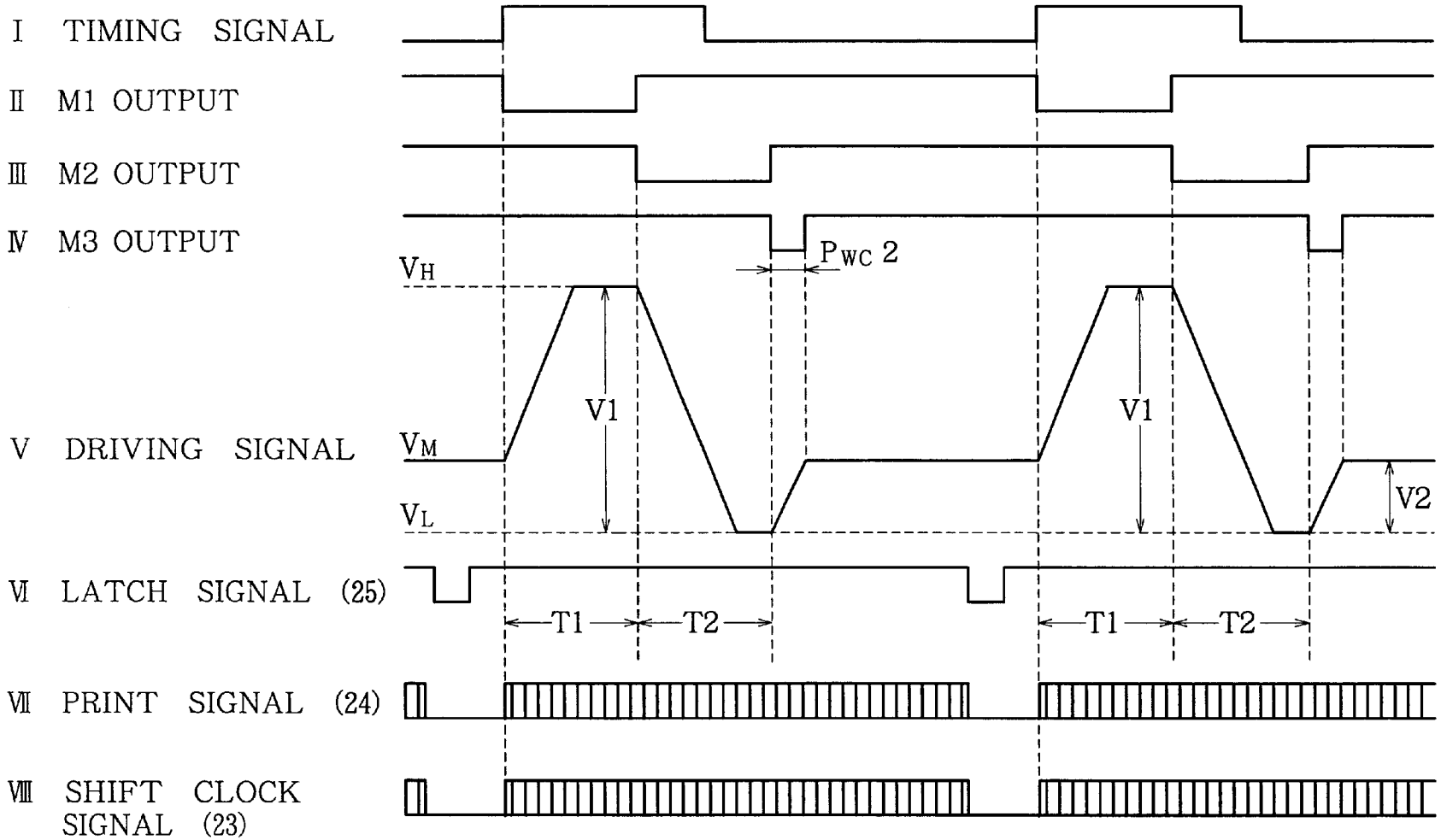
FIG. 7 is a timing diagram of assistance in explaining the operation of the ink-jet recording apparatuses in the first to the third embodiments.

The printing signals (FIG. 7(VII)) provided in a serial mode on the output terminal 24 are used as selection signals to be applied to the switching transistors 30 in the next printing cycle. The printing signals are latched by the flip-flops F1 forming the shift register in synchronism with a shift clock signal (FIG. 7(VIII)). A latch signal generating circuit 35 provides a latch signal in synchronism with the trailing edge of the carry signal. The driving signal is maintained at the medium voltage VM when the latch signal is provided by the latch signal generating circuit 35.

Figure 6:
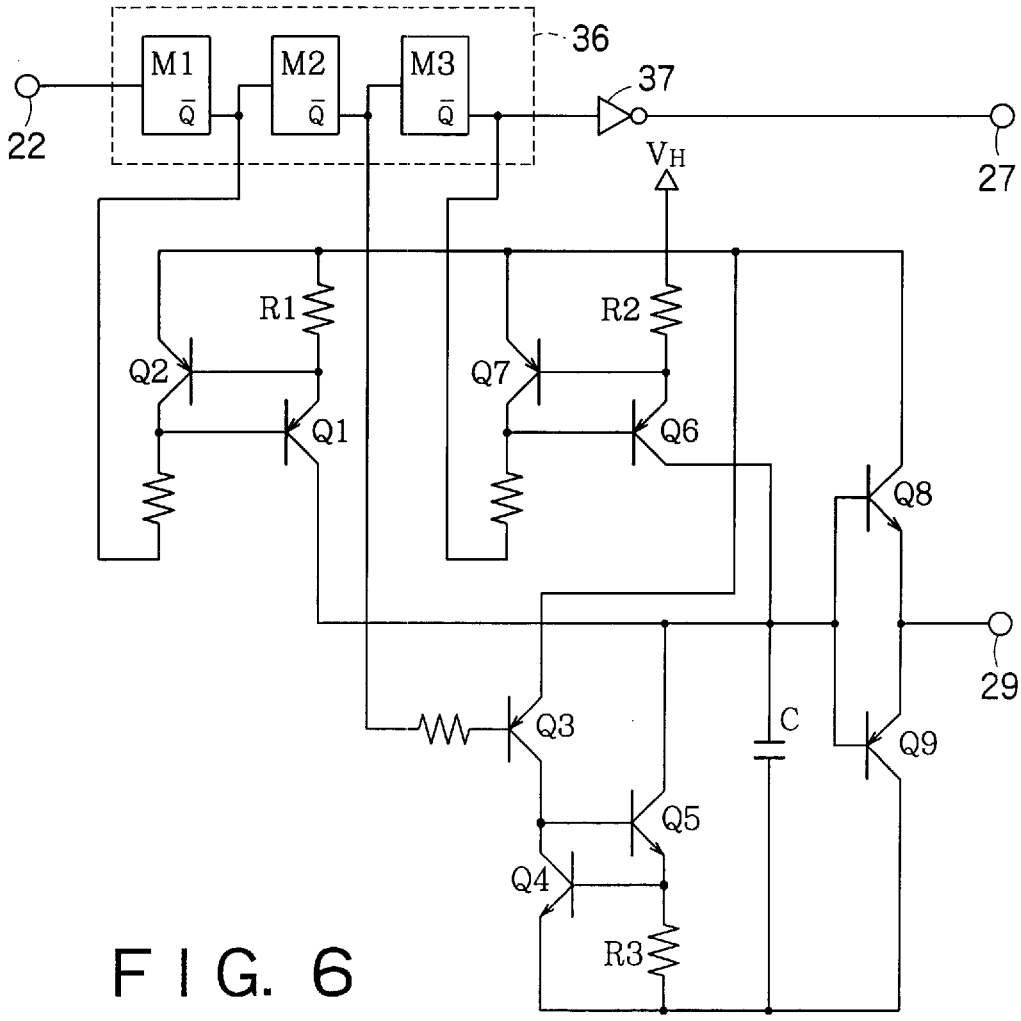
FIG. 6 is a circuit diagram of a driving signal generating circuit included in the ink-jet recording apparatuses in the first to the third embodiments.

FIG. 6 shows the driving signal generating circuit 26. A timing control circuit 26 includes three cascaded monostable multivibrators M1, M2 and M3. The monostable multivibrators M1, M2 and M3 are set, respectively, for T1=($P_{wc1}$+$P_{wh1}$), T2=($P_{wd1}$+$P_{wh2}$), and pulse widths PW1, PW2 and PW3 (FIGS. 7(II), 7(III) and (IV)) for determining a second charging time $P_{wc2}$, in which $P_{wc1}$ indicates a first charging time, $P_{wh1}$ indicates a first hold time, $P_{wd1}$ indicates a discharge time, and $P_{wh2}$ indicates a second hold time.

Pulses provided by the monostable multivibrators M1, M2 and M3 controls transistors Q2 and Q3 for on-off operation so that the transistor Q2 is charged, the transistor Q3 is discharged and the transistor Q2 is charged for second charging.

An outline of the operation of the ink-jet recording apparatus will be explained. Upon the application of the timing signal to the input terminal 22 by the external device, the monostable multivibrator M1 of the timing control circuit 36 provides a pulse signal of the predetermined pulse width PW1 ($P_{wc1}$+$P_{wh1}$) (FIG. 7(II)) to turn on a transistor Q1. Then, a capacitor initially charged at a potential $V_M$ is charged by a fixed current $I_{c1}$ determined by the transistor Q2 and a resistor R1. Upon the increase of the terminal voltage of the capacitor C to a supply voltage $V_H$, the charging operation is stopped automatically. The capacitor C maintains the voltage $V_H$ until the same is discharged.

When the state of the monostable multivibrator M1 is inverted after the elapse of the time T1 ($=P_{wc1}+P_{wh1}$) corresponding to the pulse width PW1 of the pulse signal provided by the monostable multivibrator M1, the transistor Q1 is turned off and the monostable multivibrator M2 provides a pulse signal (FIG. 7(III)) of a pulse width PW2 to turn on the transistor Q3, so that the capacitor C is discharged. During the discharge of the capacitor C, a fixed current $I_d$ determined by a transistor Q4 and a resistor R3 flows continuously until the voltage of the capacitor decreases substantially to a voltage $V_L$.

When the state of the monostable multivibrator M2 is inverted after the elapse of the time T2 ($=P_{wd1}+P_{wh2}$) corresponding to the pulse width PW2 of the pulse signal provided by the monostable multivibrator M2, the monostable multivibrator M3 provides a pulse signal of a pulse width PW3 (FIG. 7(IV)) to turn on a transistor Q6. Consequently, the capacitor C is charged again by a fixed current $I_{c2}$ at a medium voltage $V_M$ determined by a time ($P_{wc2}$) corresponding to the pulse width PW3 of the output pulse signal of the monostable multivibrator M3. Charging of the capacitor C is stepped upon the increase of the voltage of the capacitor C to the medium voltage $V_M$ and the capacitor C maintains the voltage $V_M$ until a timing signal is given again thereto.

The capacitor C is thus charged and discharged so that a driving signal increases from the medium voltage $V_M$ to the voltage $V_H$ at a fixed slope, the driving signal is held at the voltage $V_H$ for the predetermined hold time $P_{wh1}$, decreases to the voltage $V_L$ at a fixed slope, the voltage $V_L$ is held for the predetermined hold time $P_{wh2}$ and then increases again to the medium voltage $V_M$ as shown in FIG. 7.

The operation of the ink-jet recording apparatus will be described in connection with an ink particle jetting operation. The control signal generating circuit 20 provides the selection signals for selecting the switching transistors 30 in the preceding printing cycle, and the selection signals are latched by the flip-flops F1 while the medium voltage VH is applied to all the piezoelectric vibrators 9. A timing signal is given to the control signal generating circuit 20, the voltage of the driving signal (FIG. 7(V)) is increased from the medium voltage $V_M$ to the voltage $V_H$ to charge the piezoelectric vibrators 9.

The piezoelectric vibrator 9 thus charged contracts at a fixed rate to expand the corresponding pressure generating chamber 3. Then, the ink flows from the common ink chamber 4 through the ink inlet 5 into the pressure generating chamber 3 and, at the same time, a meniscus formed in the jetting hole 2 is drawn toward the pressure generating chamber. The driving signal increased to the voltage $V_H$ is held at the voltage $V_H$ for the hold time $P_{wh1}$. Charges of the piezoelectric vibrators 9 charged at the voltage $V_H$ are discharged through diodes D, the piezoelectric vibrators 9 extend to contract the corresponding pressure generating chambers 3. Consequently, the ink contained in the pressure generating chambers 3 is pressurized and ink particles are jetted through the jetting holes 2.

Figures 8A, 8B:
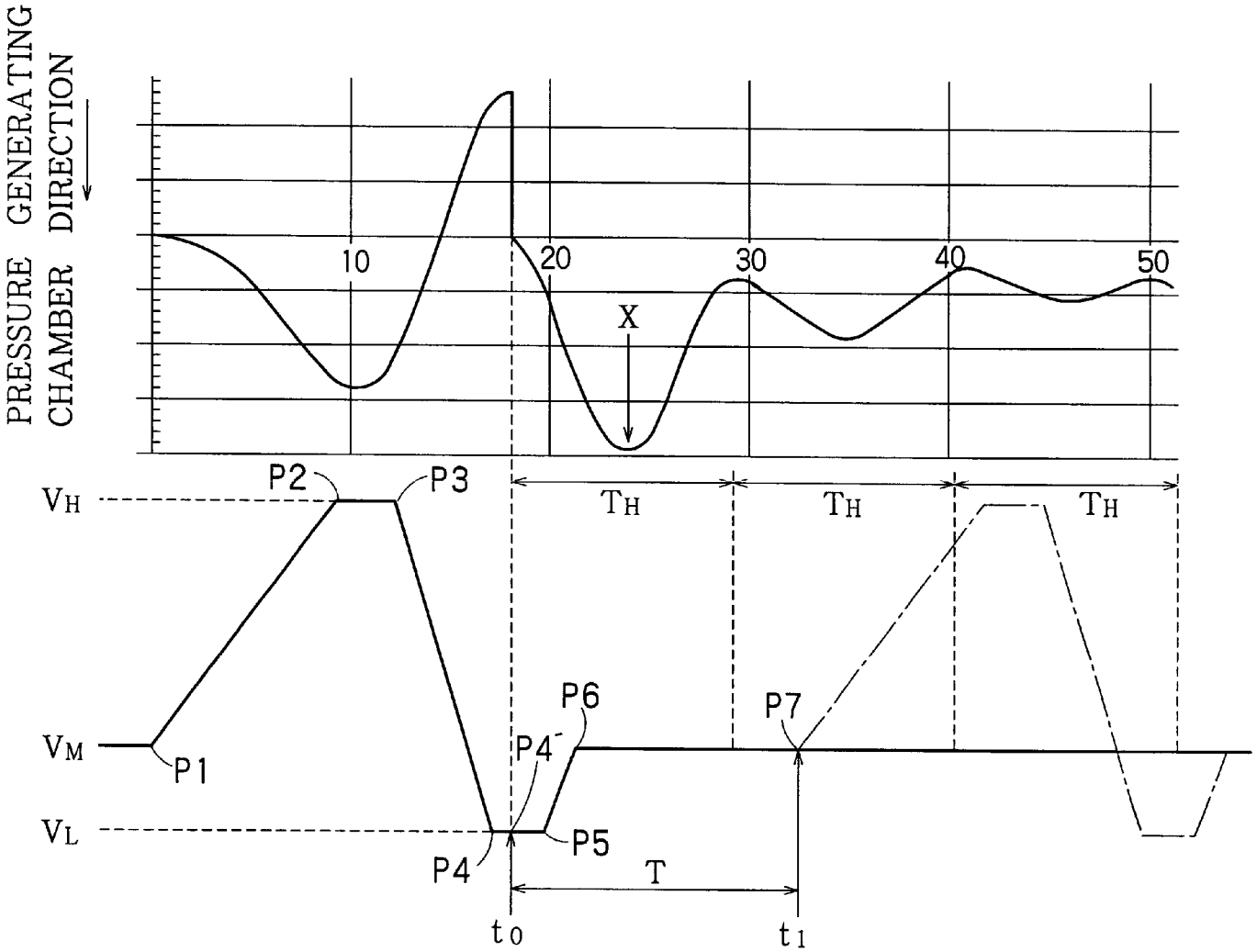
FIG. 8A is a waveform diagram of a driving pulse signal used by the ink-jet recording apparatus in the first embodiment.
FIG. 8B is a diagram of assistance in explaining the variation of a meniscus with the driving pulse signal shown in FIG. 8A.

FIG. 8A shows a driving pulse signal for successively jetting a plurality of ink particles by repeating the driving pulse generating step and the ink jetting step a plurality of times in one printing cycle. FIG. 8B shows the vibration of the meniscus when the driving pulse signal is applied to the piezoelectric vibrator 9.

As shown in FIG. 8A, a driving pulse has a filling waveform section between points P1 and P2 for expanding the pressure generating chamber 3 to fill the pressure generating chamber 3 with the ink, a holding waveform section between points P2 and P3 for keeping the pressure generating chamber 3 in an expanded state, and an ink jetting waveform section between points P3 and P4 for jetting the ink through the jetting hole by contracting the pressure generating chamber 3, a hold waveform section between points P4 and P5 and a charging waveform section between points P5 and P6. A voltage is applied to the piezoelectric vibrator 9 to damp the vibration of the meniscus in a period between points P4 and P6. The holding waveform section between points P2 and P3 is used to adjust the timing of jetting and is able to be omitted if other waveform section is used to adjust the timing of jetting.

The filling waveform section between the points P1 and P2 increases from the medium voltage $V_M$ to the voltage $V_H$ higher than the medium voltage $V_M$ at a fixed slope. The holding waveform section between the points P2 and P3 remains at the high voltage $V_H$ for a fixed time. The ink jetting waveform section between the points P3 and P4 decreases from the high voltage $V_H$ to the low voltage $V_L$ lower than the medium voltage $V_M$ at a fixed slope.

In this embodiment, the succeeding ink jetting step is started at a point P7 at time $t_1$ a time interval T after time $t_0$ when the preceding ink jetting step is ended. More concretely, the predetermined time interval T is equal to or longer than the period $T_H$ of the Helmholtz vibration of the meniscus of the ink in the jetting hole 2. When the predetermined time interval T is equal to or longer than the period $T_H$ of the Helmholtz vibration of the meniscus of the ink in the jetting hole 2, the point P7 where the succeeding ink jetting step is started can be delayed from time corresponding to the first bottom X of the Helmholtz vibration, i.e., a point when the meniscus of the ink in the jetting hole 2 is drawn toward the pressure generating chamber 3 to the utmost. Consequently, an ink particle jetted by the succeeding ink jetting step is able to hold its shape and the scatter of the ink can be prevented.

Figures 9A, 9B:
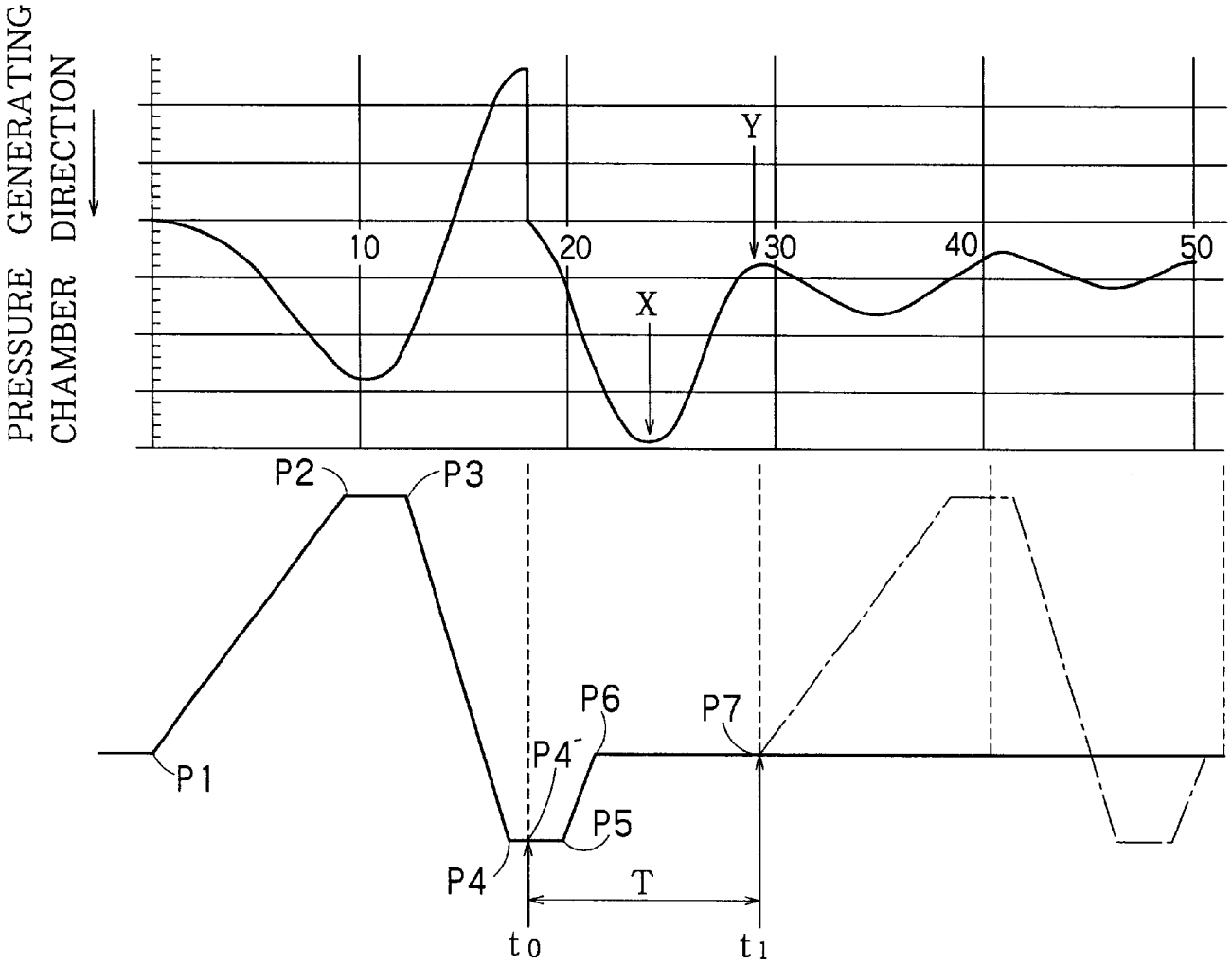
FIG. 9A is a waveform diagram of a driving pulse signal used by an ink-jet recording apparatus in a first modification of the ink-jet recording apparatus in the first embodiment.
FIG. 9B is a diagram of assistance in explaining the variation of a meniscus with the driving pulse signal shown in FIG. 9A.

In an ink-jet recording apparatus in a first modification of the ink-jet recording apparatus in the first embodiment, the predetermined time interval T is a natural multiple of the Helmholtz period $T_H$. Preferably, the time interval T is as long as one helmholtz period $T_H$ as shown in FIGS. 9A and 9B. When the predetermined time interval T is a natural multiple of the period $T_H$ of the Helmholtz vibration, a point when the succeeding ink jetting step is started can be delayed from time corresponding to the first bottom X of the Helmholtz vibration and the point when the succeeding ink jetting step is started coincides with a crest Y of the Helmholtz vibration. Consequently, an ink particle can be jetted by the succeeding ink jetting step in an optimum shape.

Figures 10A, 10B:
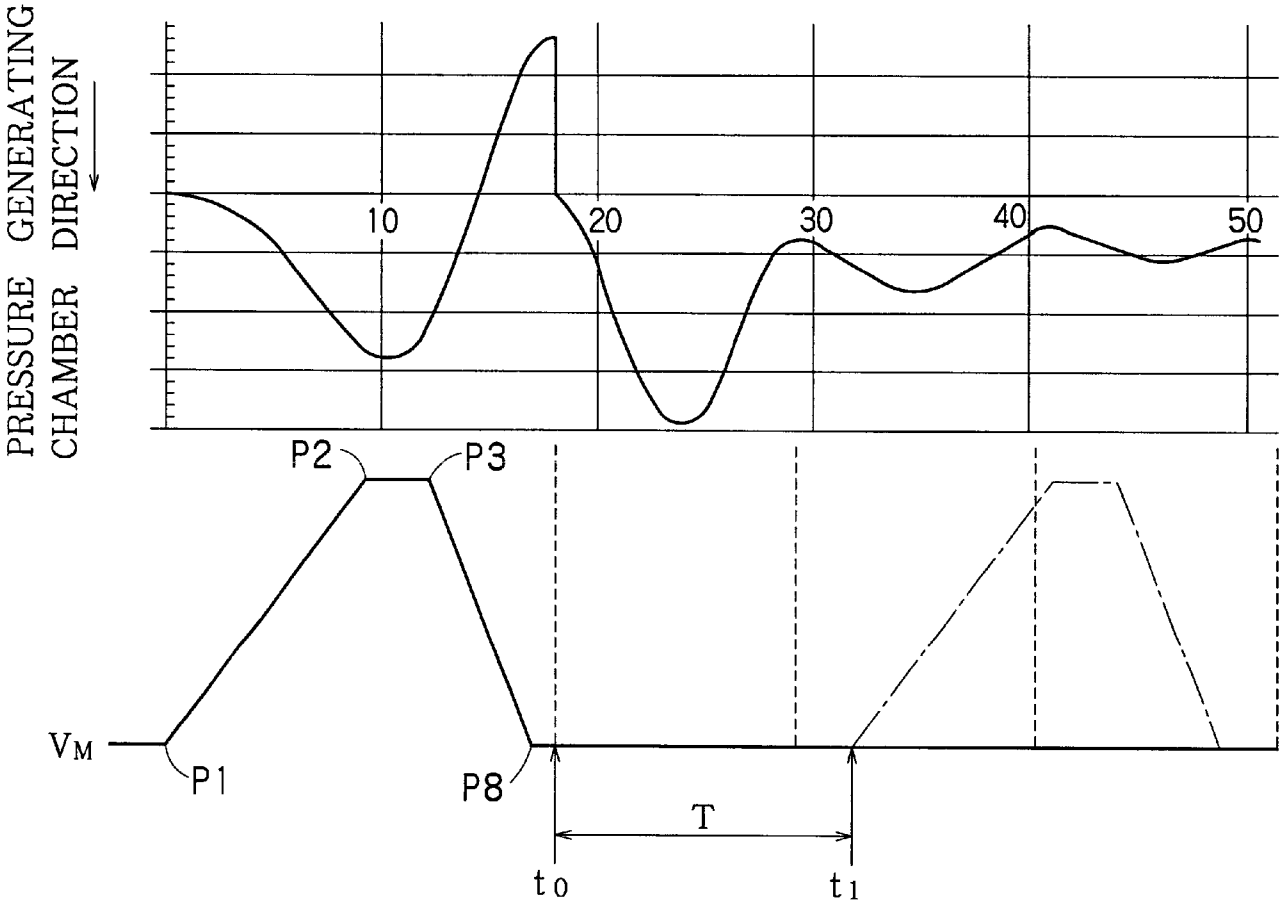
FIG. 10A is a waveform diagram of a driving pulse signal used by an ink-jet recording apparatus in a second modification of the ink-jet recording apparatus in the first embodiment.
FIG. 10B is a diagram of assistance in explaining the variation of a meniscus with the driving pulse signal shown in FIG. 10A.

In an ink-jet recording apparatus in a second modification of the ink-jet recording apparatus in the first embodiment, a point P8 where the ink jetting waveform section of the driving pulse is ended may be held at the medium voltage $V_M$ and the sections P4 to P6 in the driving pulse shown in FIG. 8A may be omitted as shown in FIGS. 10A and 10B.

Figures 11A, 11B:
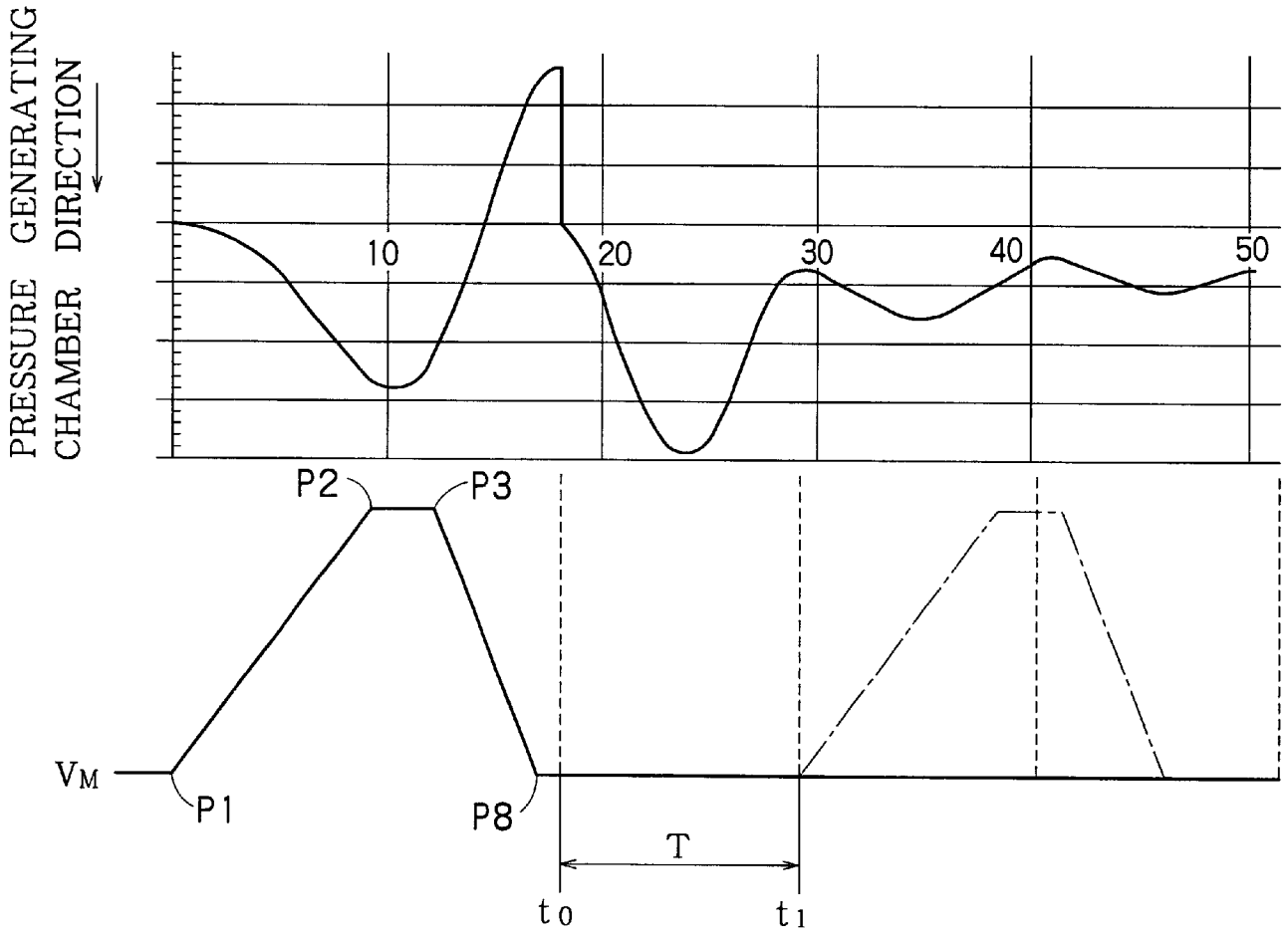
FIG. 11A is a waveform diagram of a driving pulse signal used by an ink-jet recording apparatus in a third modification of the ink-jet recording apparatus in the first embodiment.
FIG. 11B is a diagram of assistance in explaining the variation of a meniscus with the driving pulse signal shown in FIG. 11A.

In an ink-jet recording apparatus in a third modification of the ink-jet recording apparatus in the first embodiment, a point P8 where the ink jetting waveform section of the driving pulse is ended may be held at the medium voltage $V_M$ and the sections P4 to P6 of the driving pulse shown in FIG. 9A may be omitted as shown in FIGS. 11A and 11B.

In an ink-jet recording apparatus in a fourth modification of the ink-jet recording apparatus in the first embodiment, a driving pulse may have an ink jetting wave form section for jetting an ink particle through the jetting hole 2 by contracting the pressure generating chamber 3 held in an expanded state in a waiting state to jet the ink particle by the push-jet driving method.

In the ink-jet recording head of the foregoing embodiment, the pressure generating chamber 3 is expanded by charging and the pressure generating chamber 3 is contracted by discharging. The present invention is applicable to an ink-jet recording head in which a pressure generating chamber is expanded by discharging and can be contracted by charging.

Figure 12:
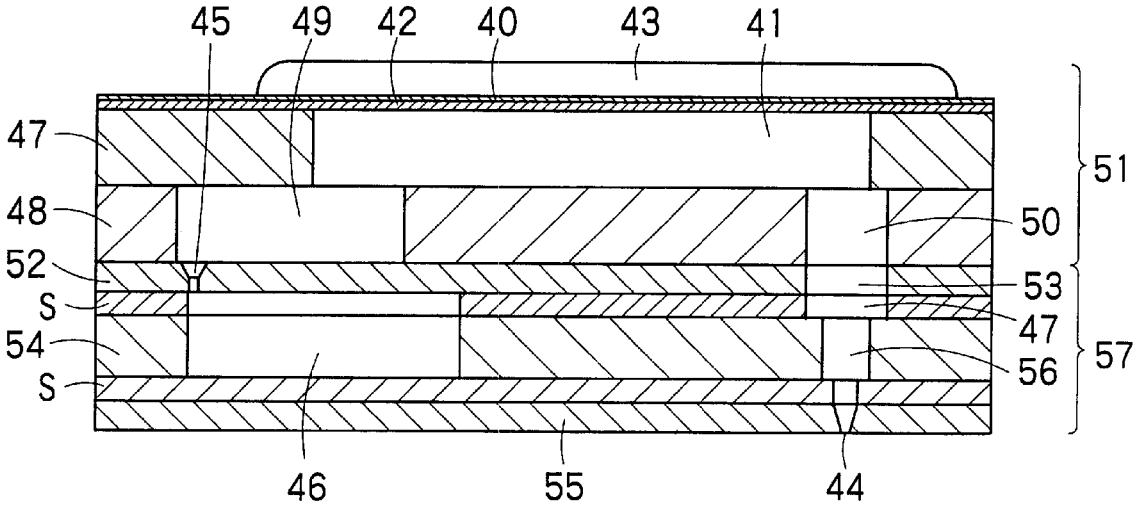
FIG. 12 is a sectional view of another ink-jet recording head to which the present invention is applicable.

FIG. 12 shows such an ink-jet recording head to which the present invention is applicable. As shown in FIG. 12, the ink-jet recording head has a first cover plate 40, which is a thin zirconia plate of about 10 $\mu$m in thickness, driving electrodes 42 formed on the outer surface of the first cover plate 40 so as to correspond to pressure generating chambers 41, and piezoelectric vibrators (pressure generating devices) 43 attached to the outer surfaces of the driving electrodes 42, respectively.

The pressure generating chamber 41 is made to contract and expand by the flexural vibration of the piezoelectric vibrator 43 to jet an ink particle through a jetting hole 44, and to suck the ink through an ink inlet 45 from a common ink chamber 46. A spacer 47 is a plate of a thickness suitable for forming the pressure generating chamber 41, such as 150 $\mu$m, made of a ceramic material, such as zirconia ($ZrO_2$), and provided with openings. The first cover 40 and a second plate 48 are attached closely to the opposite surfaces of the spacer 47 to define the pressure generating chambers 41.

The second cover plate 48 is a plate made of a ceramic material, such as zirconia, provided with connecting holes 49 each connecting the pressure generating chamber 41 and the ink inlet 45, and ink discharge openings 50 through which the ink is discharged from the pressure generating chamber 41 toward the jetting holes 44.

The first cover plate 40, the spacer 47 and the second cover plate 48 are integrated into an actuator unit 51 by forming green pieces of a ceramic material for the first cover plate 40, the spacer 47 and the second cover plate 48, laminating the green pieces in a green structure corresponding to the actuator unit 51 and sintering the green structure.

An ink supply plate 52 serves also as a base plate for the actuator unit 51. The ink supply plate 52 is formed so as to be provided with a connecting member for connecting an ink cartridge to the ink supply plate 52 of a material resistant to the corrosive action of the ink, such as a stainless steel or a ceramic material.

The ink supply plate 52 is provided with the ink inlets 45 connecting the common ink chamber 46 to the pressure generating chambers 41 in one end part thereof on the side of the pressure generating chambers 41, and with connecting holes 53 connecting the ink discharge openings 50 of the actuator unit 51 to the jetting holes 44 in the other end part thereof.

A common ink chamber plate 54 has a thickness suitable for forming the common ink chamber 46, such as 150 $\mu$m, and is formed of a corrosion-resistant material, such as a stainless steel. The common ink chamber plate 54 is provided with an opening of a shape corresponding to that of the common ink chamber 46 and through holes 56 connecting the ink discharge openings 50 to the jetting holes 44 formed in a nozzle plate 55.

The ink supply plate 52, the common ink chamber plate 54 and the nozzle plate 55 are integrated into an ink passage unit 57 by bonding together the ink supply plate 52, the common ink chamber plate 54 and the nozzle plate 55 with adhesive layers S, such as films of a heat-bonding material or an adhesive.

The ink-jet recording head is completed by bonding the actuator unit 51 to the surface of the ink supply plate 52 of the ink passage unit 57 with an adhesive.

In a normal state, the piezoelectric vibrator 43 is charged at a predetermined voltage in a contracted state. The piezoelectric vibrator 43 is discharged to cause the ink to flow from the common ink chamber 46 through the ink inlet 45 into the pressure generating chamber 41 by making the pressure generating chamber 41 expand. The piezoelectric vibrator 43 is charged after holding the same at a discharged potential for a predetermined time necessary for the adjacent piezoelectric vibrator 43 to which any driving signal is not applied to draw the meniscus toward the corresponding pressure generating chambers 41.

Figure 13:
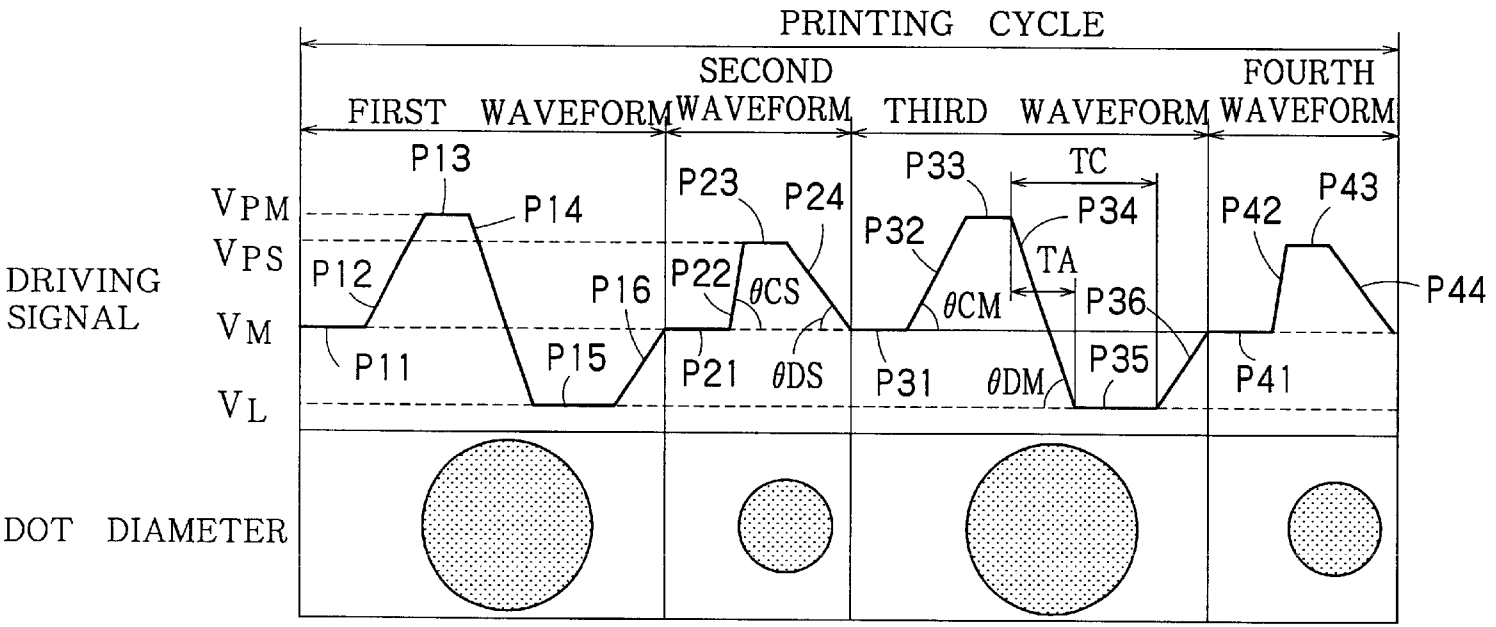
FIG. 13 is a diagram showing driving signals used by the ink-jet recording apparatus in the first embodiment to generate a medium dot driving pulse and a small dot driving pulse, respectively.

This embodiment is applicable to generating a medium dot driving pulse and a small dot driving pulse from a common driving signal. FIG. 13 shows the relation between the shapes of driving pulses of the common driving signal for producing medium dot and small dot driving pulses, and the size of jetted ink particles and illustrates a method of forming dots by a driving signal to express gradation. A driving signal generated by the driving signal generating circuit 26 (FIG. 4) represents a first driving waveform including second and fourth waveforms, and a second driving waveform including a first waveform and a third wave form.

The first and the third waveform of the second driving waveform have the same shape and are used for jetting a medium ink particle of, for example, about 10 ng. Ink particles jetted by using the first and the third waveforms form medium dots.

The second and the fourth waveform of the first driving waveform have the same shape. Each of the second and the fourth waveform is formed between the first and the third waveform. The second and the fourth waveform of the first driving waveform are used for jetting a small ink particle of, for example about 2 ng to form small dots. Thus, the small dots are about ⅕ of the medium dots.

The waveforms of the driving signal will be described with reference to FIG. 13. Since the first and the third waveform are identical in shape and the second and the fourth waveform are identical in shape, only the first and the second waveform will be described.

As shown in FIG. 13, the first waveform of the second driving waveform has a waveform section P11 at a medium voltage VM, a waveform section P12 increasing at a predetermined voltage slope θCM from the medium voltage VM to a maximum voltage VPM, a waveform section P13 maintained at the maximum voltage VPM for a predetermined time, and a waveform section P14 decreasing at a predetermined voltage slope θDM from the maximum voltage VPM to a lowest voltage VL.

The slope θDM for discharging is greater than the slope θCM for charging. Time necessary for the first waveform to decrease from the maximum voltage VPM to the lowest voltage VL is substantially equal to the period TA of the natural vibration of the piezoelectric vibrator 9. Preferably, the lowest voltage VL is equal to a ground level (0 V) or a positive voltage to prevent the inversion of polarization of the piezoelectric vibrator 9.

The first waveform has a waveform section P15 held at the lowest voltage VL for a predetermined time, and waveform section P16 increasing from the lowest voltage VL to the medium voltage VM.

The second waveform of the first driving waveform has a waveform section P21 at the medium voltage VM, a waveform section P22 increasing at the predetermined voltage slope θCS from the medium voltage VM to a maximum voltage VPS lower than the maximum voltage VPM for the first and the third waveform, a waveform section P23 maintained at the maximum voltage VPS for a predetermined time, and a waveform section P24 decreasing at a predetermined voltage slope θDS from the maximum voltage VPS to the medium voltage Vm.

The slope θCS for charging is greater than the slope θDS for discharging. Therefore, when the piezoelectric vibrator 9 is charged, the meniscus is drawn suddenly and vibrates for a Helmholtz vibration to jet a minute ink particle.

As noted above, the third and fourth waveforms are identical in shape to the first and second waveforms, respectively. Therefore, in FIG. 13, the designation numbers of the third waveform, P31, P32, P33, P34, P35, and P36, correspond to P11, P12, P13, P14, P15, and P16, respectively, of the first waveform, and the designation numbers of the fourth waveform, P41, P42, P43, and P44, correspond to P21, P22, P23, and P24, respectively, of the second waveform.

An ink-jet recording head driving method and an ink-jet recording apparatus in a second embodiment according to the present invention will be described with reference to FIG. 14. The second embodiment differs from the first embodiment in a method of setting a predetermined time interval T corresponding to the predetermined time T between the time $t_0$ when the preceding ink jetting step is ended and a point P7 ($=t_1$) when the succeeding ink jetting step is started in the first embodiment, and is the same as the first embodiment in other respects.

Figures 14A, 14B:
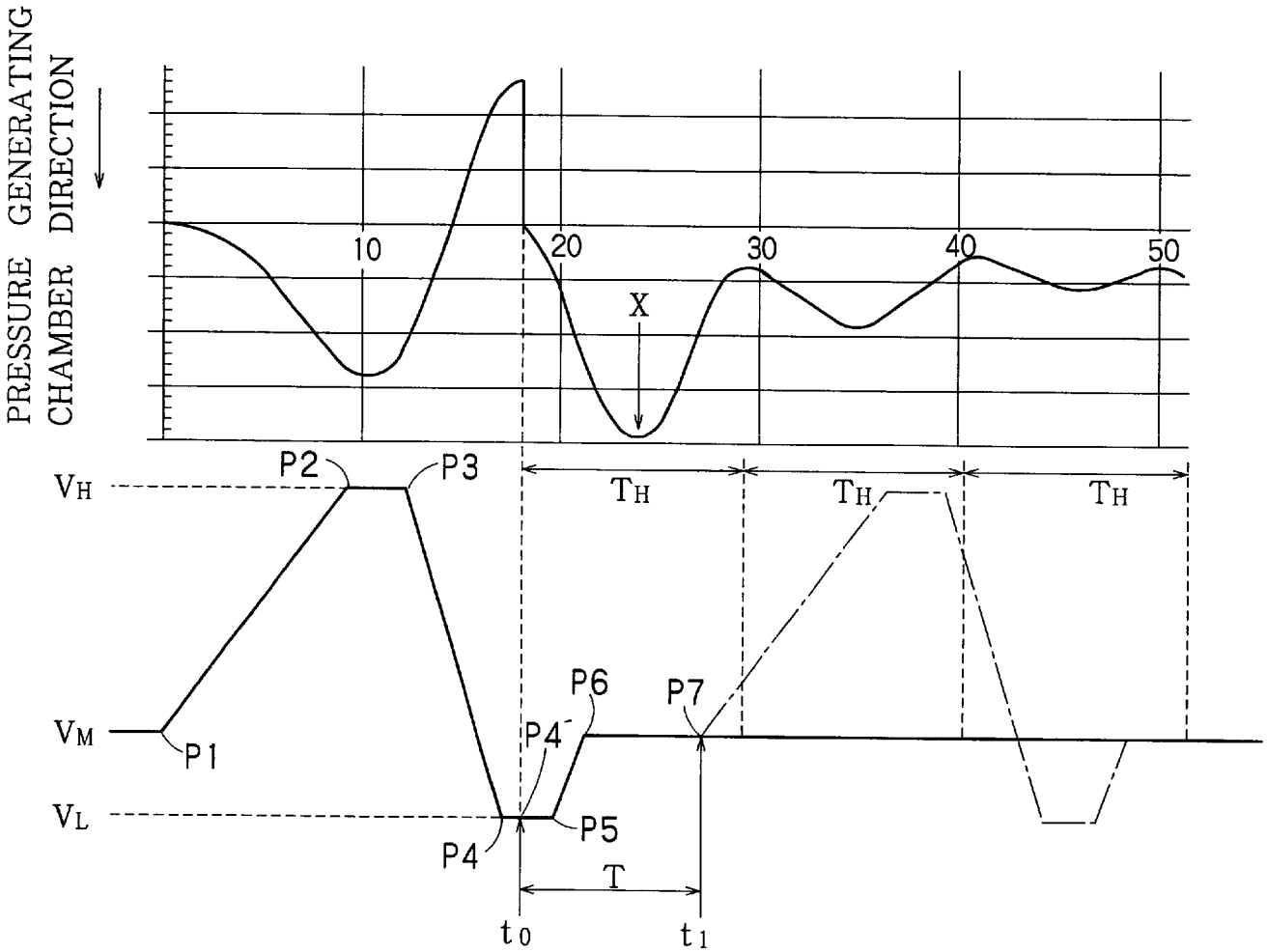
FIG. 14A is a waveform diagram of a driving pulse signal used by an ink-jet recording apparatus in a second embodiment according to the present invention.
FIG. 14B is a diagram of assistance in explaining the variation of a meniscus with the driving pulse signal shown in FIG. 14A.

Referring to FIG. 14, the predetermined time interval T is determined so that the succeeding ink jetting step is started at a point P7 after time X when the meniscus in the jetting hole 2 caused to vibrate by the preceding ink jetting step is drawn inward to the utmost. Since the coincidence of the time when the succeeding ink jetting step is started with the point X most inappropriate for starting the succeeding ink jetting step can be avoided, scatter of ink particles can be prevented.

Figures 15A, 15B:
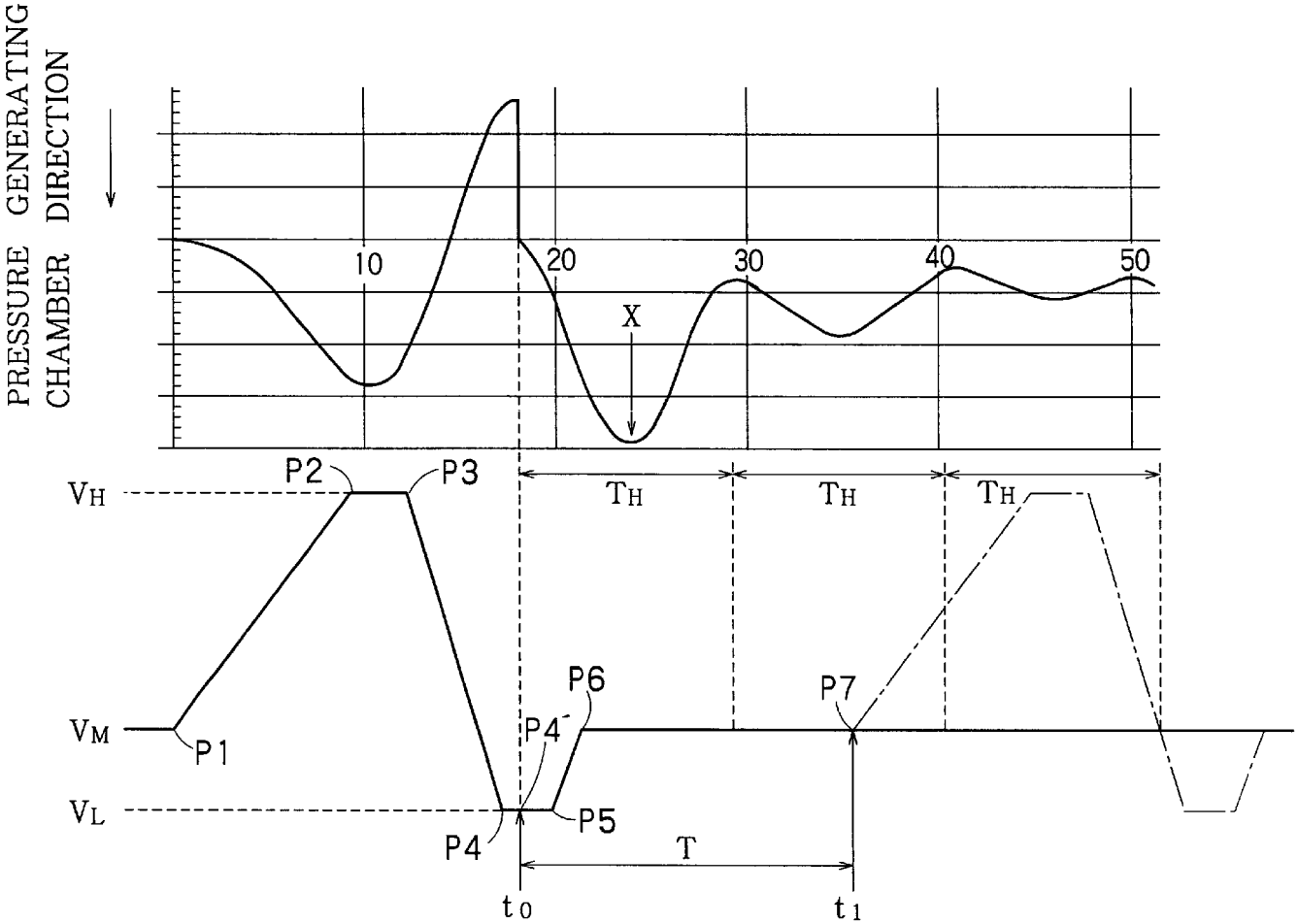
FIG. 15A is a waveform diagram of a driving pulse signal used by an ink-jet recording apparatus in a third embodiment according to the present invention.
FIG. 15B is a diagram of assistance in explaining the variation of a meniscus with the driving pulse signal shown in FIG. 15A.

An ink-jet recording head driving method and an ink-jet recording apparatus in a third embodiment according to the present invention will be described with reference to FIGS. 15 and 16. The third embodiment differs from the first embodiment in the method of setting a predetermined time interval T corresponding to the predetermined time T between the time $t_0$ when the preceding ink jetting step is ended and a point P7 ($=t_1$) when the succeeding ink jetting step is started in the first embodiment, and is the same as the first embodiment in other respects.

Figures 16A, 16B:
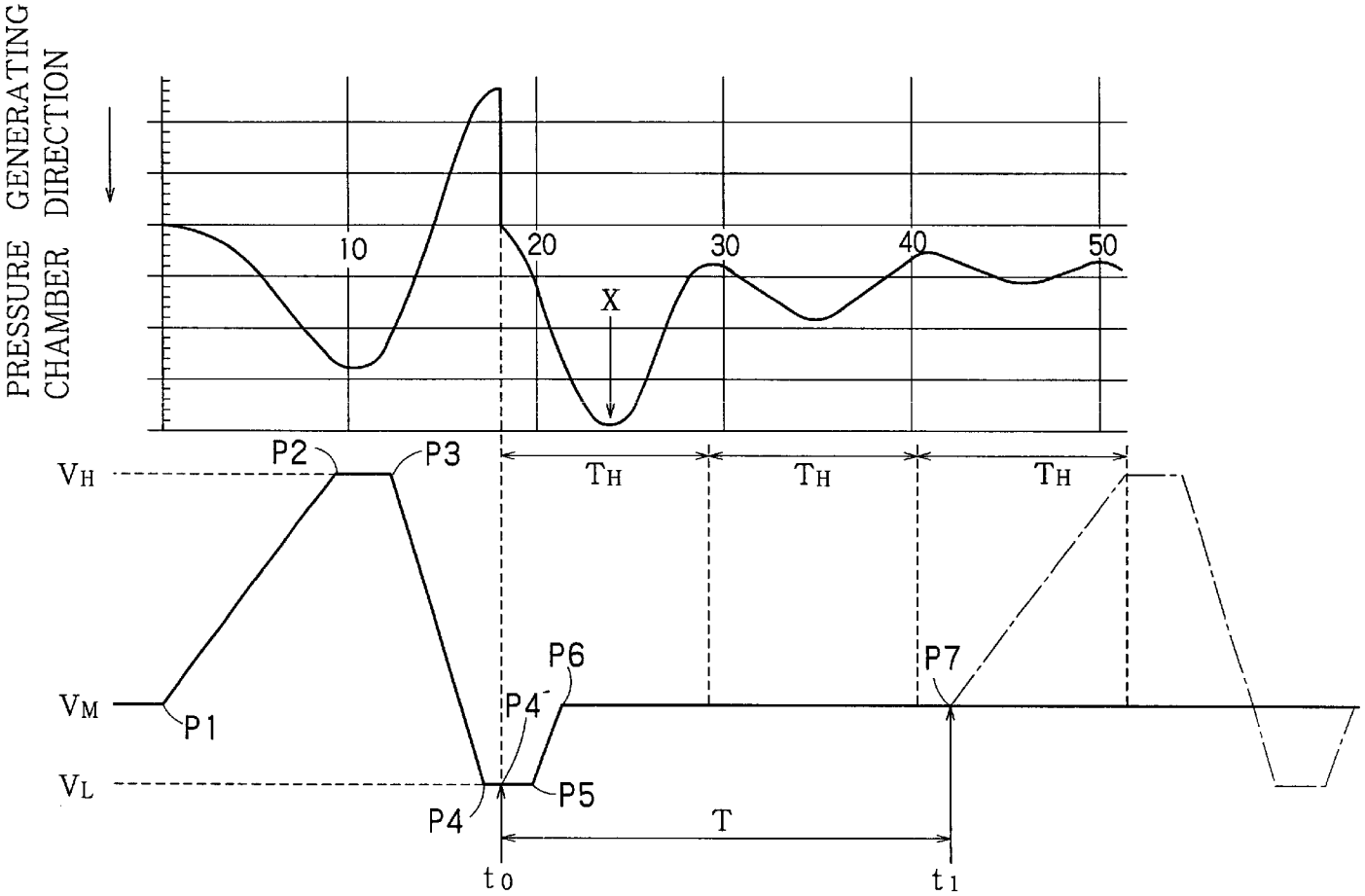
FIG. 16A is a waveform diagram of a driving pulse signal used by an ink-jet recording apparatus in a modification of the ink-jet recording apparatus in the third embodiment.
FIG. 16B is a diagram of assistance in explaining the variation of a meniscus with the driving pulse signal shown in FIG. 16A.

In the third embodiment, the predetermined time interval T is determined so that the succeeding ink jetting step is started at a point when the vibration of the meniscus in the jetting hole 2 caused by the preceding ink jetting step is substantially stabilized. The point when the vibration of the meniscus of the ink in the jetting hole 2 is substantially stabilized is a point of time when the amplitude of vibration of the meniscus is decreased to about 30% (an amplitude corresponding to about two graduations on the vertical axis in FIG. 15B) of a maximum amplitude (an amplitude corresponding to about seven graduations on the vertical axis in FIG. 15B) or below. More preferably, the point when the vibration of the meniscus of the ink in the jetting hole 2 is substantially stabilized is a point of time when the amplitude of vibration of the meniscus is decreased to about 15% (an amplitude corresponding to about one graduation on the vertical axis in FIG. 15B) of the maximum amplitude or below as shown in FIGS. 16A and 16B.

In the third embodiment, the succeeding ink jetting step is started after the vibration of the meniscus in the jetting hole 2 has substantially stabilized. Therefore the scatter of ink particles can be prevented.

The second and the third embodiment, similarly to the first embodiment, may use driving pulses as shown in FIG. 10 and 11, and may employ the push-jet driving method previously explained in connection with FIG. 3 and may employ a recording head as shown in FIG. 12.

The first to third embodiments can be applied to an ink-jet recording apparatus which uses a computer readable medium having a data on the driving signal waveform stored thereon. A computer read the data to control a jetting of an ink particle by the ink-jet recording apparatus.

Figure 17:
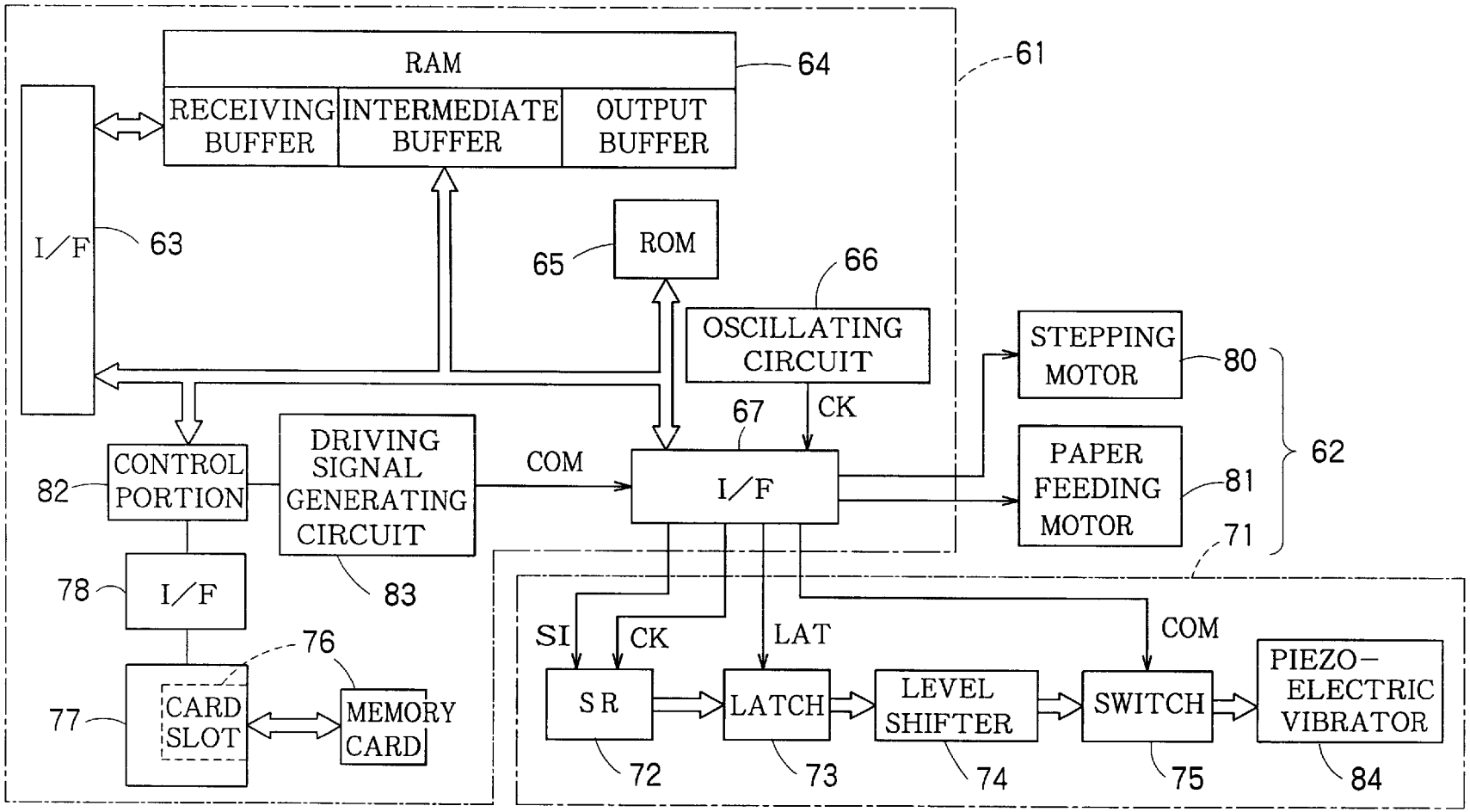
FIG. 17 is an electric diagram of an ink-jet recording apparatus in which a computer readable medium having data on driving signal waveform can be used.

FIG. 17 is a block diagram showing an electric configuration of this kind of ink-jet recording apparatus having a printer controller 61 and print engine 62. The printer controller 61 has an interface 63 which receives a printing data from a host computer (not shown), RAM 64 which stores several kinds of data, ROM 65 which stored control routines for several kinds of data processing, a control portion 82 which consists of a CPU, an oscillating circuit 66, a driving signal generating circuit 83 which generates driving signals supplied to a recording head, and an interface 67 which transmits print data and driving signals in the form of dot pattern data (bit map data) to the print engine 62.

The print controller 61 has a card slot 77 which detachably holds a memory card 76 and functions as a medium holder and a card interface 78 which transmits the information stored on the memory card 76 to the control portion 82. The memory card is a kind of computer readable medium according to the present invention and has data on driving signal waveforms stored thereon. Not only the memory card 76 but also other types of computer readable media can be used as the computer readable medium according to the present invention. For example, a floppy disk, a hard disk and a photo-magneto-electric disk, etc., can be used.

The control portion 82 is a kind of computer applicable to the present invention and controls ink jetting operations with reference to the driving signal waveform data stored on the memory card 76 and the control routines stored on the ROM 65.

The interface 63 receives the print data which consists of one of or some of the character code, graphic functions and image data from the host computer. The interface 63 can transmit a busy (BUSY) signal and an acknowledging (ACK) signal, etc., to the host computer.

The RAM 64 functions as a receiving buffer, an intermediate buffer, an output buffer and/or a work memory (not shown). The receiving buffer temporarily stores print data from a host computer, the intermediate buffer stores intermediate code data, and the output buffer expands dot pattern data.

The ROM 65 stores several control routines, font data and graphic functions, etc., which are performed by the control portion 82.

The ROM 65 stores the control routines (control programs) which are permanently used without any changes. On the other hand, the memory card 76 stores the data and/or program which is planned to be changed or updated, such as the data on the driving signal waveform.

The control portion 82 controls the driving signal generating circuit 83 according to the data on the driving signal waveform which is read from the memory card 76 so that the driving signal generating circuit 83 generates a predetermined driving signal. The driving signals generated by the driving signal generating circuit 83 are the same as those explained in the first to third embodiments.

The print engine 62 includes a stepping motor 80, a paper feeding motor 81 and an electric driving system 71 of the recording head. The electric driving system 71 of the recording head includes shift registers 72, latch circuits 73, level shifters 74, switches 75 and piezoelectric vibrators 84.

Figure 18:
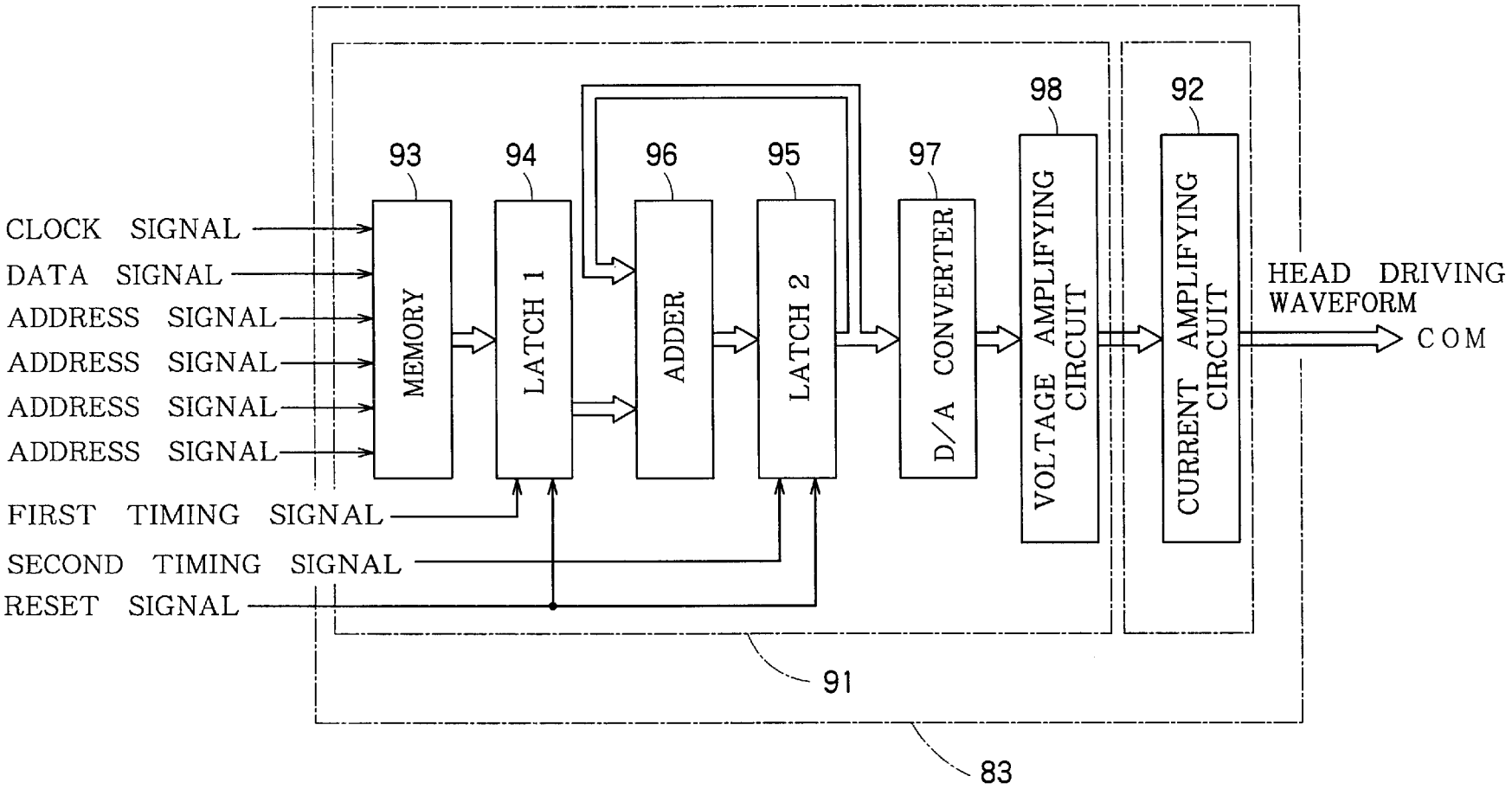
FIG. 18 is an electric diagram of a driving signal generating circuit.
Figures 19A, 19B:
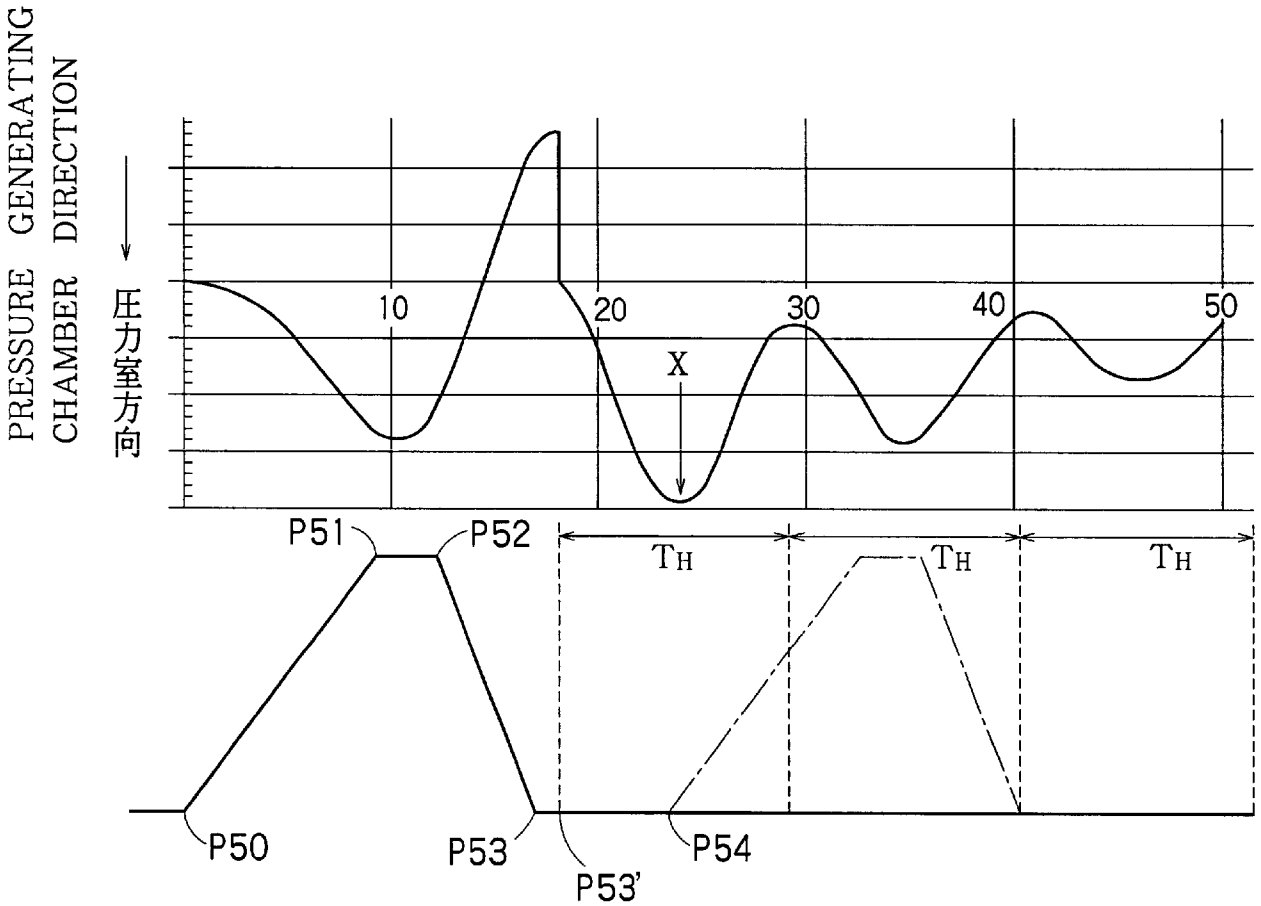
FIG. 19A is a waveform diagram of a driving pulse signal used by a conventional ink-jet recording apparatus.
FIG. 19B is a diagram of assistance in explaining the variation of a meniscus with the driving pulse signal shown in FIG. 19A.

FIG. 18 shows an example of the driving signal generating circuit 83 which has a waveform generating circuit 91 and a current amplifying circuit 92.

The waveform generating circuit 91 includes a waveform memory 93, a first waveform latch circuit 94, second waveform latch circuit 95, an adder 96, a digital-analog converter 97 and a voltage amplifying circuit 98.

The waveform memory 93 functions as variation data storing means which stores respectively the several kinds of data on voltage variations outputted from the control portion 82. The first waveform latch circuit 94 is electrically connected to the waveform memory 93. The first waveform latch circuit 94 holds the voltage variation data which is stored on predetermined addresses of the waveform memory 93 in synchronism with the first timing signals. Outputs of the first and second waveform latch circuits 94, 95 are inputted into the adder 96. The second waveform latch circuit 95 is electrically connected to the output side of the adder 96. The adder 96 functions as variation data adding means which adds output signals with each other and output the results.

The second waveform latch circuit 95 functions as output data holding means which holds the data (voltage information) outputted from the adder 96 in synchronism with the second timing signals. The digital-analog converter 97 is electrically connected to the output side of the second waveform latch circuit 95 and converts output signals held by the second waveform latch circuit 95 into analog signals. The voltage amplifying circuit 98 is electrically connected to the output side of the digital-analog converter 97 and amplifies analog signals converted by the digital-analog converter 97 to the voltages of driving signals.

The current amplifying circuit 92 is electrically connected to the output side of the voltage amplifying circuit 98. The current amplifying circuit 92 amplifies the current of the voltage signals which are amplified by the voltage amplifying circuit 98 and outputs the results as the driving signals (COM).

In the driving signal generating circuit 83 having the above-mentioned configuration, prior to the generations of the driving signals, several variation data showing voltage variations are stored on the memory area of the waveform memory 93 respectively. For example, the control portion 82 outputs the variation data and the address data corresponding to the variation data into the waveform memory 93. The waveform memory 93 stores the variation data on the memory area addressed by the address data. The variation data consists of the data which includes plus and minus information (increase and decrease information). The address data consists of the address signals of 4 bits.

When several kinds of variation data are stored on the waveform memory 93 as mentioned above, the driving signal can be generated.

In order to generate the driving signal, the variation data is set in the first waveform latch circuit 94. In accordance with a predetermined renewal period, the variation data set in the first waveform latch circuit 94 is added to the output voltage from the second waveform latch circuit 95.

The computer applicable to the present invention is not restricted to the control portion 82. For example, a host computer which is directly connected to the recording apparatus as a single unit can be applied to the present invention. One of the computers which are connected via a network can be applied to the present invention.

As is apparent from the foregoing description, according to the present invention, since the predetermined time interval (T) between the end of the preceding ink jetting step and the start of the succeeding ink jetting step is adjusted so that the point when the succeeding ink jetting step is started can be delayed from time corresponding to the first bottom (X) of the Helmholtz vibration, an ink particle jetted by the succeeding ink jetting step is able to hold its shape and the scatter of the ink particles can be prevented.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. An ink-jet recording head driving method of driving an ink-jet recording head having a pressure generating device corresponding to a pressure generating chamber communication with a jetting hole and having a specific period ($T_H$) of Helmholtz vibration, said ink-jet recording head driving method comprising:

a driving pulse generating step of generating a driving pulse by taking out part of a driving signal having a time length corresponding to one printing cycle and including a plurality of driving pulse waves; and an ink jetting step of jetting an ink particle through the jetting hole by applying the driving pulse to the pressure generating device to drive the pressure generating device for a predetermined operation;

wherein the driving signal has a waveform that makes a time interval between a point when a preceding ink jetting step is ended and a point when a succeeding ink jetting step is started is equal to or longer than one period ($T_H$) of the Helmholtz vibration of a meniscus when the driving pulse generating step and the ink jetting step are repeated a plurality of times in one printing cycle to jet a plurality of the ink particles;

wherein the driving signal has a waveform that makes a succeeding ink jetting step start after a point of time when a meniscus of ink in the jetting hole is drawn toward the pressure generating chamber to the utmost by the preceding ink jetting step when the driving pulse generating step and the ink jetting step are repeated a plurality of times in one printing cycle to jet a plurality of the ink particles.

2. The ink-jet recording head driving method according to claim 1, wherein the time interval is a natural multiple of the period ($T_H$) of the Helmholtz vibration of the meniscus.

3. The ink-jet recording head driving method according to claim 1, wherein the driving pulse has a filling waveform section for expanding the pressure generating chamber to fill the pressure generating chamber with the ink and an ink jetting waveform section for jetting the ink through the jetting hole by contracting the pressure generating chamber.

4. The ink-jet recording head driving method according to claim 3, wherein the driving pulse further comprises a holding waveform section for keeping the pressure generating chamber in an expanded state caused by the filling waveform section.

5. The ink-jet recording head driving method according to claim 3, wherein the filling waveform section is a waveform section which increases a voltage at a fixed slope so as to make the pressure generating chamber expand, and the ink jetting waveform section is a waveform section which decreases a voltage at a fixed slope so as to make the pressure generating chamber contract.

6. The ink-jet recording head driving method according to claim 1, wherein the driving pulse has an ink jetting waveform section that makes the pressure generating chamber held in an expanded state contract to jet an ink particle through the jetting hole.

7. The ink-jet recording head driving method according to claim 1, wherein the time interval is equal to or longer than one period ($T_H$) of the Helmholtz vibration of the meniscus and is equal to or shorter than two periods ($T_H$) of the Helmholtz vibration of the meniscus.

8. An ink-jet recording apparatus comprising:

an ink-jet recording head provided with a pressure generating chamber communicating with a jetting hole through which an ink particle is jetted and having a specific period ($T_H$) of Helmholtz vibration, and a pressure generating device corresponding to the pressure generating chamber; and a head driving unit that generates a driving pulse by taking out part of a driving signal having a time length corresponding to one printing cycle and including a plurality of driving pulse waves and applies the driving pulse to the pressure generating device to drive the pressure generating device for a predetermined operation to jet an ink particle through the jetting hole;

wherein the driving signal has a waveform that makes a time interval between a point when a preceding ink jetting step is ended and a point when a succeeding ink jetting step is started is equal to or longer than one period ($T_H$) of the Helmholtz vibration of a meniscus when the head driving unit repeats the ink jetting step a plurality of times in one printing cycle to jet a plurality of the ink particles; and wherein the driving signal has a waveform that makes a succeeding ink jetting step start after a point of time when a meniscus of the ink in the jetting hole is drawn toward the pressure generating chamber to the utmost by a preceding ink jetting step when the dead driving unit repeats the ink jetting step a plurality of times in one printing cycle to jet a plurality of the ink particles.

9. The ink-jet recording apparatus according to claim 8, wherein the time interval is a natural multiple of the period ($T_H$) of the Helmholtz vibration of the meniscus.

10. The ink-jet recording apparatus according to claim 8, wherein the driving pulse has a filling waveform section for expanding the pressure generating chamber to fill the pressure generating chamber with the ink and an ink jetting waveform section for jetting the ink through the jetting hole by contracting the pressure generating chamber.

11. The ink-jet recording apparatus according to claim 10, wherein the driving pulse further comprises a holding waveform section for keeping the pressure generating chamber in an expanded state caused by the filling waveform section.

12. The ink-jet recording apparatus according to claim 10, wherein the filling waveform section is a waveform section which increases a voltage at a fixed slope so as to make the pressure generating chamber expand, and the ink jetting waveform section is a waveform section which decreases a voltage at a fixed slope so as to make the pressure generating chamber contract.

13. The ink-jet recording apparatus according to claim 8, wherein the driving pulse has an ink jetting waveform section that makes the pressure generating chamber held in an expanded state contract to jet the ink particle through the jetting hole.

14. The ink-jet recording apparatus according to claim 8, wherein the time interval is equal to or longer than one period ($T_H$) of the Helmholtz vibration of the meniscus and is equal to or shorter than two periods ($T_H$) of the Helmholtz vibration of the meniscus.

* * * * *